US008463157B2

(12) United States Patent
Sakurai et al.

(10) Patent No.: US 8,463,157 B2
(45) Date of Patent: Jun. 11, 2013

(54) ELECTROPHOTOGRAPHIC IMAGE FORMING APPARATUS WITH MOVABLE TRAY FOR MOUNTING CARTRIDGES

(75) Inventors: Hiromi Sakurai, Suntou-gun (JP); Tomio Noguchi, Suntou-gun (JP); Chikara Imaizumi, Numazu (JP); Takeo Kawanami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/372,685

(22) Filed: Feb. 14, 2012

(65) Prior Publication Data

US 2012/0141165 A1 Jun. 7, 2012

Related U.S. Application Data

(62) Division of application No. 12/122,990, filed on May 19, 2008, now Pat. No. 8,145,095.

(30) Foreign Application Priority Data

May 23, 2007 (JP) ..... 2007-136453
Mar. 10, 2008 (JP) ..... 2008-059560

(51) Int. Cl.
*G03G 15/00* (2006.01)
*G03G 21/16* (2006.01)

(52) U.S. Cl.
CPC ..... *G03G 21/16* (2013.01)
USPC ..... 399/110

(58) Field of Classification Search
USPC ..... 399/114, 112, 110, 113
See application file for complete search history.

(56) References Cited

U.S. PATENT DOCUMENTS 5,608,498 A 3/1997 Nagase et al.
6,647,228 B2 * 11/2003 Nakamura et al. ..... 399/124
7,058,336 B2 6/2006 Murakami et al.
7,187,886 B2 3/2007 Kawasumi (Continued)

FOREIGN PATENT DOCUMENTS

JP 8-220824 8/1996
JP 11-003024 1/1999

(Continued)

OTHER PUBLICATIONS

PCT International Search Report, Written Opinion of International Searching Authority, and Notification of Transmittal of International Search Report and Written Opinion in Application No. PCT/JP2008/059619 issued Oct. 13, 2008.

(Continued)

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

An electrophotographic image forming apparatus includes a process cartridge which is mounted on a pull-out type cartridge tray to enable front access. The electrophotographic image forming apparatus includes an urging unit for urging and moving the cartridge tray toward a front of a main assembly of the apparatus and a clocking member for locking the cartridge tray in a proper position so that the cartridge tray is returned back to an outside position of the apparatus when the cartridge tray is pushed to the proper position.

14 Claims, 25 Drawing Sheets

U.S. PATENT DOCUMENTS

| | | | | |
|---|---|---|---|---|
| 7,529,505 | B2 | 5/2009 | Okamoto | |
| 7,778,567 | B2 | 8/2010 | Igarashi et al. | |
| 2004/0190040 | A1 | 9/2004 | Fukao et al. | |
| 2006/0140674 | A1 | 6/2006 | Sato | |
| 2006/0233566 | A1* | 10/2006 | Ikebata | 399/110 |
| 2006/0251443 | A1 | 11/2006 | Abe et al. | |
| 2006/0257164 | A1 | 11/2006 | Hoshi et al. | |
| 2007/0053716 | A1 | 3/2007 | Itabashi | |
| 2007/0160380 | A1 | 7/2007 | Imaizumi et al. | |
| 2007/0160384 | A1 | 7/2007 | Sakurai et al. | |
| 2007/0160385 | A1 | 7/2007 | Noguchi et al. | |
| 2008/0159773 | A1 | 7/2008 | Murayama et al. | |

FOREIGN PATENT DOCUMENTS

| | | |
|---|---|---|
| JP | 11-015355 | 1/1999 |
| JP | 2002-214874 | 7/2002 |
| JP | 2005-266672 | 9/2005 |
| JP | 2006-098492 | 4/2006 |
| JP | 2006-098772 | 4/2006 |
| JP | 2006-259148 | 9/2006 |

OTHER PUBLICATIONS

Russian Decision on Grant in Application No. 2009118114, dated Oct. 28, 2010, with English translation.

Office Action in Korean Applciation No. 10-2009-702128, dated Mar. 18, 2011.

Translation of Mar. 18, 2011 Office Action in Korean Application No. 10-2009-702128.

Notice of Allowance in Korean Patent Application No. 10-2011-7022485, mailed Oct. 18, 2011.

Notice of Allowance in Koean Patent Application No. 10-2009-7025128, mailed Oct. 21, 2011.

Office Action in Japanese Patent Application No. 2008-059560, dated Sep. 6, 2011, with English translation.

English translation of Oct. 21, 2011 Notice of Allowance in Korean Patent Application No. 10-2009-7025128.

English translation of Oct. 18, 2011 Notice of Allowance in Korean Patent Application No. 10-2011-7022485.

* cited by examiner

ELECTROPHOTOGRAPHIC IMAGE FORMING APPARATUS WITH MOVABLE TRAY FOR MOUNTING CARTRIDGES

This application is a divisional of co-pending application Ser. No. 12/122,990, filed May 19, 2008.

FIELD OF THE INVENTION AND RELATED ART

The present invention relates to an electrophotographic image forming apparatus for forming an image on a recording medium.

The electrophotographic image forming apparatus forms an image on the recording medium through an electrophotographic image forming method. The electrophotographic image forming apparatus may include, e.g., an electrophotographic copying machine, an electrophotographic printer (such as a laser beam printer or an LED printer), a facsimile apparatus, a word processor, etc.

The term "cartridge" refers to a cartridge, including at least a developer accommodating portion for accommodating a developer, detachably mountable to a main assembly of the electrophotographic image forming apparatus.

The cartridge can be mounted to and demounted from the image forming apparatus by a user oneself, so that it is possible to easily perform maintenance of the image forming apparatus.

As a method of replacing a cartridge of an image forming apparatus, Japanese Laid-Open Patent Application No. Hei 8-220824 discloses a constitution in which a cartridge 30 is supported through a guide member 70 capable of expanding and contracting in two steps with respect to an ascending/descending plate 61 which is moved forward and backward and up and down in interrelation with a side surface cover 80. The side surface cover 80 is opened to raise and move the cartridge 30 from an image forming position (I) to a pull-out position (II). Then the cartridge 30 is directly pulled out so as to be optionally moved to a specific position including a stopping position (III), thus enabling attachment/detachment of each piece of equipment or member and jammed paper processing.

The present invention has further developed the above described conventional constitution.

SUMMARY OF THE INVENTION

A principal object of the present invention is to provide an electrophotographic image forming apparatus capable of improving usability in a cartridge replaceable constitution.

According to an aspect of the present invention, there is provided an electrophotographic image forming apparatus comprising:

a cartridge including a developer accommodating portion for accommodating a developer;

a tray movable between a pull-out position in which the tray is outside of a main assembly of the apparatus and a push-in position in which the tray is inside of the main assembly of the apparatus, the tray including a mounting portion for detachably mounting the cartridge in the pull-out position and a manual operating portion for facilitating pulling-out the tray;

an urging member for urging the tray from the push-in position toward the pull-out position;

a regulating member for regulating movement of the tray toward the pull-out position when the tray is located in the push-in position; and a releasing portion for releasing regulation by the regulating member by operation of the manual operating portion in a state in which the tray is located in the push-in position, wherein the tray is moved toward the pull-out position by the urging member when the regulation by the regulating member is released.

According to another aspect of the present invention, there is provided an electrophotographic image forming apparatus comprising:

a cartridge including a developer accommodating portion for accommodating a developer;

a tray movable between a pull-out position in which the tray is pulled out an outside of a main assembly of the apparatus and a push-in position in which the tray is pushed in an inside of the main assembly of the apparatus, the tray including a mounting portion for detachably mounting the cartridge in the pull-out position;

an urging member for urging the tray from the push-in position toward the pull-out position; and a regulating member for regulating movement of the tray toward the pull-out position when the tray is located in the push-in position; and wherein the tray is moved toward the pull-out position by being urged toward the pull-out position by the urging member when the tray is located in a predetermined position, out of the push-in position, between the push-in position and the pull-out position.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(General Structure of Image Forming Apparatus)

An image forming apparatus of this embodiment is an electrophotographic image forming apparatus to which a cartridge is detachably mountable.

A general structure of this image forming apparatus will be described with reference to FIGS. 1, 2, 7 and 8.

Figure 1:
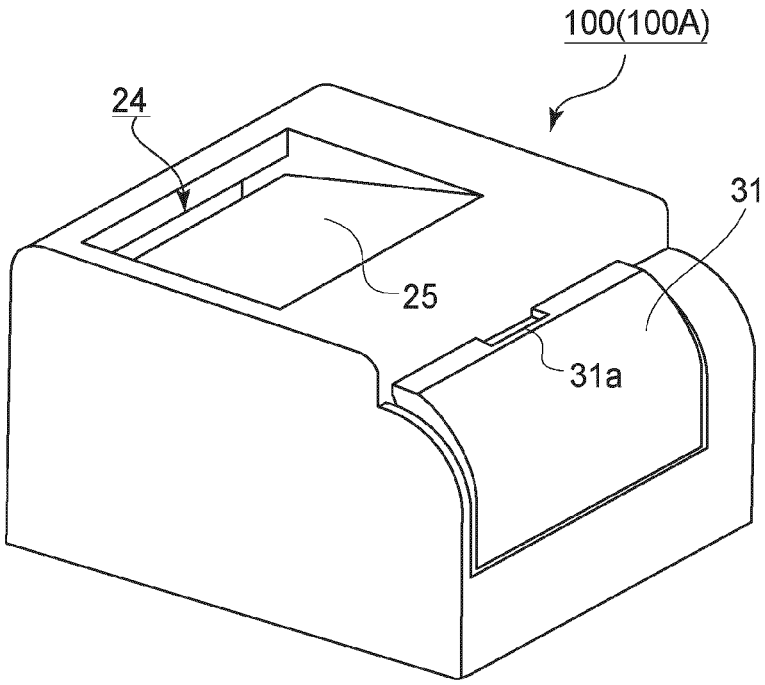
FIG. 1 is a perspective view of the outer appearance of the image forming apparatus in Embodiment 1 of the present invention.
Figure 2:
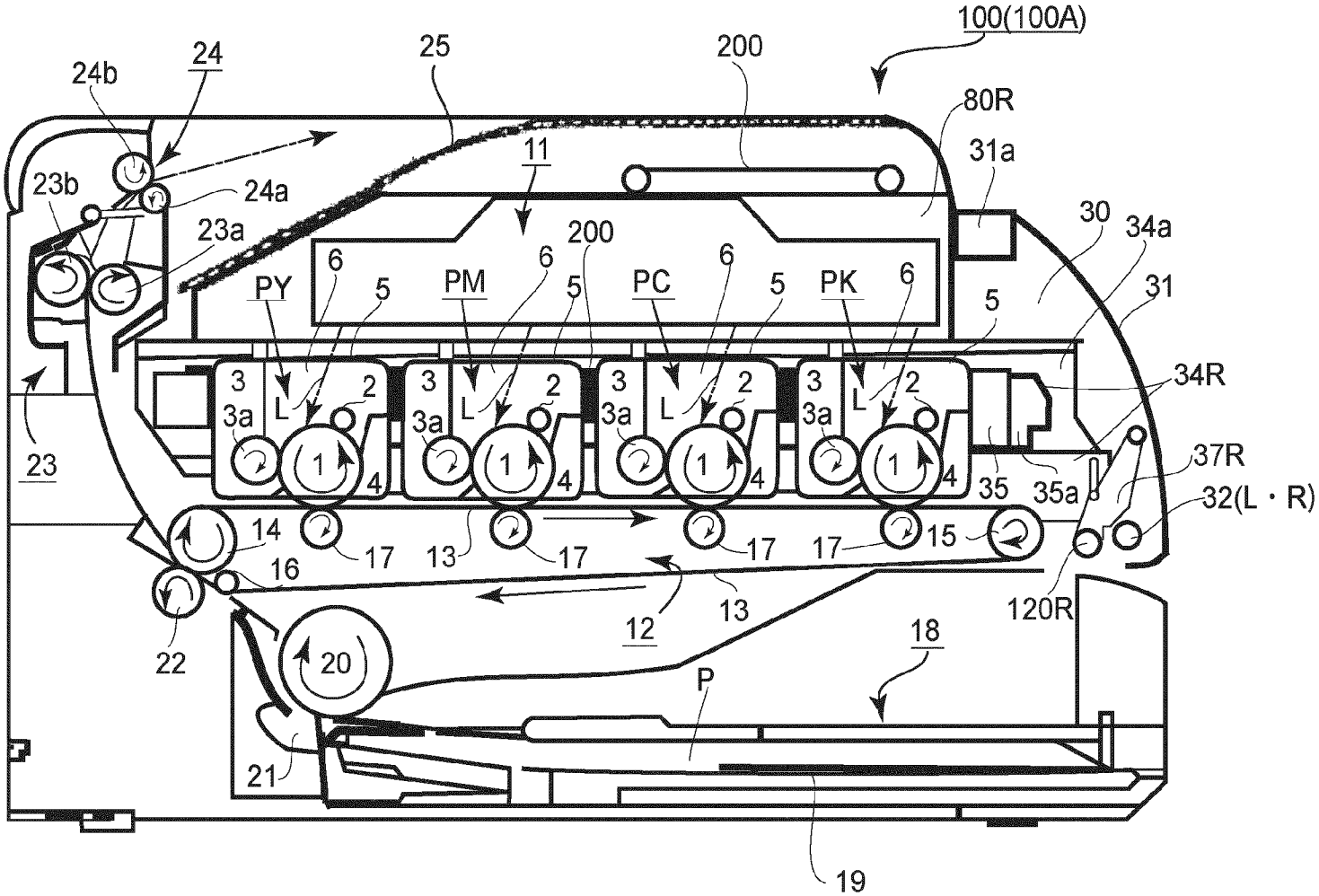
FIG. 2 is a longitudinal sectional view of the image forming apparatus shown in FIG. 1, as seen from the left side of the apparatus.

FIG. 1 is an external perspective view of an outer appearance of an image forming apparatus 100 in this embodiment, and FIG. 2 is a longitudinal sectional view of the image forming apparatus 100, as seen from the left side of the apparatus. This image forming apparatus is a four color-based full-color laser printer using an electrophotographic process. That is, the image forming apparatus forms an image on a recording medium (sheet) based on electrical picture (image) signals inputted from an external host apparatus (not shown) such as a personal computer, an image reader, a sending facsimile machine, etc.

In the following description, a front side (front surface side) of the image forming apparatus 100 means the side on which a door 31 as an opening/closing member is provided. A rear side of the image forming apparatus 100 is the side opposite to the front side. "Frontward" means "in a direction toward front as seen from the rear side of the image forming apparatus 100 apparatus main assembly", and "rearward" means the direction opposite to "frontward". "The left and right sides" means the left and right sides (of the apparatus main assembly) as seen from the front side of the image forming apparatus 100. "Leftward" means "in a direction toward left as seen from the front side", and "rightward" means the direction opposite to "leftward". An apparatus main assembly (main assembly frame) 100A is an image forming apparatus portion other than the cartridge.

In the apparatus main assembly 100A, four (first to fourth) cartridges PY, PM, PC and PK are horizontally arranged in the listed order in terms of the rear-to-front direction (inline or tandem arrangement). The four cartridges have the same constitution except that they accommodate toners different in color. Each cartridge in this embodiment includes a drum-type electrophotographic photosensitive member 1 as a first image carrying member (hereinafter simply referred to as a "drum"), a developing device 3, and a cleaning device 4, which are integrally assembled in a cartridge frame 5. The charging device 2 is a contact-type charging roller. The developing device 3 includes a developing roller 3*a*, as a developer carrying member, for carrying a developer in order to develop a latent image formed on the drum 1 and a developer container including an accommodating portion for accommodating the developer (toner). The cleaning device 4 is of a blade type.

The developing device 3 of the first cartridge PY stores yellow (Y) toner. On the peripheral surface of the drum 1 in the cartridge PY, a toner (developer) image of yellow (Y) is formed. The developing device 3 of the second cartridge PM stores magenta (M) toner. On the peripheral surface of the drum 1 in the cartridge PM, a toner image of magenta (M) is formed. The developing device 3 of the third cartridge PC stores cyan (C) toner. On the peripheral surface of the drum 1 in the cartridge PC, a toner image of cyan (C) is formed. The developing device 3 of the fourth cartridge PK stores black (K) toner. On the peripheral surface of the drum 1 in the cartridge PK, a toner image of black (K) is formed.

In the area above the cartridges PY, PM, PC, and PK, a laser scanner unit 11 is disposed. This scanner unit 11 outputs a beam of laser light L modulated corresponding to image (picture) information for each color inputted from an external host apparatus into a control circuit portion 200. The outputted laser light L transmits through an exposure window 6 provided at an upper surface of the cartridge frame 5 and enters each cartridge. Thus, laser scanning exposure is performed on the surface of the drum 1.

The apparatus main assembly 100A includes an intermediary transfer belt unit 12. This belt unit 12 is disposed below the cartridges P (PY, PM, PC, PK). The belt unit 12 includes an endless belt 13. The belt 13 is a transfer member (second image carrying member) contactable with the drum 1 of each cartridge. The belt 13 is formed of a dielectric material and has flexibility. Inside the belt 13, there are provided a driving roller 14, a turn roller 15 and a tension roller 16 around which the belt 13 is stretched and circulatively moved. The driving roller 14 and tension roller 16 are disposed on the rear side of the apparatus main assembly 100A, whereas the turn roller 15 is disposed on the front side of the apparatus main assembly 100A. A lower surface of the drum 1 of each cartridge P contacts an upper surface of the belt 13. Inside the belt 13, four primary transfer rollers 17 are also disposed. Each transfer roller 17 is disposed opposite to the drum 1 in the corresponding cartridge through the endless belt 13. The driving roller 14 is disposed opposite to a secondary transfer roller 22 through the belt 13.

Below the belt unit 12, a sheet feeding unit 18 is disposed, which includes a sheet feeding cassette 19, a feeding roller 20, and a separation pad 21. The sheet feeding cassette 19 is detachably mountable in the apparatus main assembly 100A from the front side (front loading).

At an upper portion on the rear side of the apparatus main assembly 100A, a fixing device 23 and a sheet discharging roller pair 24 are disposed. Further, at an upper surface of the apparatus main assembly 100A, a sheet discharging portion 25 is provided. The fixing device 23 includes a fixation film assembly 23*a* and a pressing roller 23*b*. The sheet discharging roller pair 24 includes sheet discharging rollers 24*a* and 24*b*.

Each cartridge P located in a transfer contact position (latent image forming position) in the apparatus main assembly 100A is fixed at a predetermined positioning portion by being pressed by a pressing member described later. The transfer contact position (latent image forming position) is a position in which the drum 1 and the belt 13 contact each other and in which a latent image can be formed on the drum 1. At this transfer contact position, a driving force input portion of the cartridge P is in engagement with a driving force output portion of the apparatus main assembly 100A. To electrical contacts of the cartridge P, an electrical energy supplying system of the apparatus main assembly 100A is electrically connected.

The operation carried out by this image forming apparatus to form a full-color image is as follows. The drum 1 of each of the first to fourth cartridges P (PY, PM, PC and PK) is rotationally driven at a predetermined speed in a counterclockwise direction indicated by an arrow. Further, the belt 13 is rotationally driven in a clockwise direction indicated by an arrow (the (normal) rotational direction of the drum 1) at a speed which corresponds to the speed of the drum 1. The scanner unit 11 is also driven. In synchronization with the driving of the scanner unit 11, the charging roller 2 in each cartridge P uniformly electrically charges the surface of the drum 1 to a predetermined polarity and potential with a predetermined timing. The scanner unit 11 scans (exposes) the surface of each drum 1 with the beam of laser light L modulated corresponding to the picture (image) signals for respective colors. As a result, an electrostatic latent image corresponding to the picture signals for corresponding color is formed on the surface of the drum 1. This electrostatic latent image is developed by the developing device 3 into a developer image (toner image).

Through the above described electrophotographic image forming process, a yellow toner image, which corresponds to the yellow color component of a full-color image is formed on the drum 1 of the first cartridge PY. This yellow toner image is primary-transferred onto the belt 13.

On the drum 1 of the second cartridge PM, a magenta developer image, which corresponds to the magenta component of the full-color image is formed, and this toner image is transferred (primary transfer) onto the belt 13 so that it is superposed on the yellow toner image which has already been transferred on the belt 13.

On the drum 1 of the second cartridge PC, a cyan developer image, which corresponds to the cyan component of the full-color image is formed, and this developer image is primary-transferred onto the belt 13 so that it is superposed on the yellow and magenta toner images which have already been transferred to the belt 13.

On the drum 1 of the second cartridge PK, a black developer image, which corresponds to the black component of the full-color image is formed, and this developer image is primary-transferred onto the belt 13 so that it is superposed on the yellow, magenta, and cyan toner images which have already been transferred on the belt 13.

Consequently, an unfixed full-color toner image is synthetically formed on the belt 13 by the yellow, magenta, cyan and black toner images.

After the primary transfer, the transfer residual toner remaining on the surface of the drum 1 in each cartridge is removed by the cleaning device 4.

Meanwhile, the sheet feeding roller 20 is driven with a predetermined timing. Sheets P stacked on the sheet feeding cassette 19 are separated and fed one by one by cooperation of the sheet feeding roller 20 and the separation pad 21. As a result, the sheet P is introduced into a nip (secondary transfer nip) between the secondary transfer roller 22 and belt 13. During nip-conveyance of the sheet P, superposed four color toner images are simultaneously transferred onto the sheet P.

The sheet P is separated from the surface of the belt 13 and introduced into the fixing device 23, and is subjected to heat and pressure in a fixation nip of the fixing device 23. As a result, color mixing of the respective color toner images and fixation thereof on the sheet P are performed. Thereafter, the sheet P is moved out of the fixing device 23, and then, is discharged as a full-color image formation product onto the sheet discharge portion 25 by the discharge roller pair 24.

After the separation of the sheet P from the belt 13, secondary-transfer residual toner remaining on the surface of the belt 13 is removed by a cleaning means 4 (not shown).

(Cartridge Replacing Method)

A cartridge replacing method will be described with reference to FIGS. 1-10, 17, 19, 22 and 23.

As an image forming operation is carried out by each of the first to fourth cartridge PY, PM, PC, and PK, the developer (toner) stored in the developing device 3 of each cartridge is consumed. Then, when the developer is consumed to such an extent that an image of a quality satisfactory to a user who has purchased the cartridges cannot be formed, the commercial value as the cartridge is lost.

For this reason, e.g., the image forming apparatus is provided with a means (not shown) for detecting the amount of the developer remaining in each cartridge. The detected amount of the developer in each cartridge is compared, by the control circuit portion 200, with a threshold value preset for issuing a service-life prewarning or warning. When the detected amount of the residual developer in the cartridge is smaller than the preset threshold value, the service-life prewarning or warning is displayed on a display portion (not shown). By this, the image forming apparatus prompts the user to prepare a replacement cartridge, or to replace the cartridge, in order to maintain an output image quality.

In this embodiment, the replacement of the cartridge P is performed through a method in which the cartridge is placed on a pull-out type tray 35 and is replaced in a front-access manner. As a result, usability is improved.

Here, on the front side of the apparatus main assembly 100A, an opening 30 is provided through which the tray 35 (cartridge P) passes when the cartridge P is pushed in the inside of the apparatus main assembly 100A or is pulled out from the apparatus main assembly 100A.

Further, on the front side of the apparatus main assembly 100A, a rotatable door 31 is provided. This door 31 is an opening/closing member locatable in a closing position for closing the opening 30 and in an opening position for opening the opening 30.

In this embodiment, at lower left and lower right portions of the door 31, horizontal (lateral) shafts 32 (32L and 32R) as hinges are provided.

Figure 3:
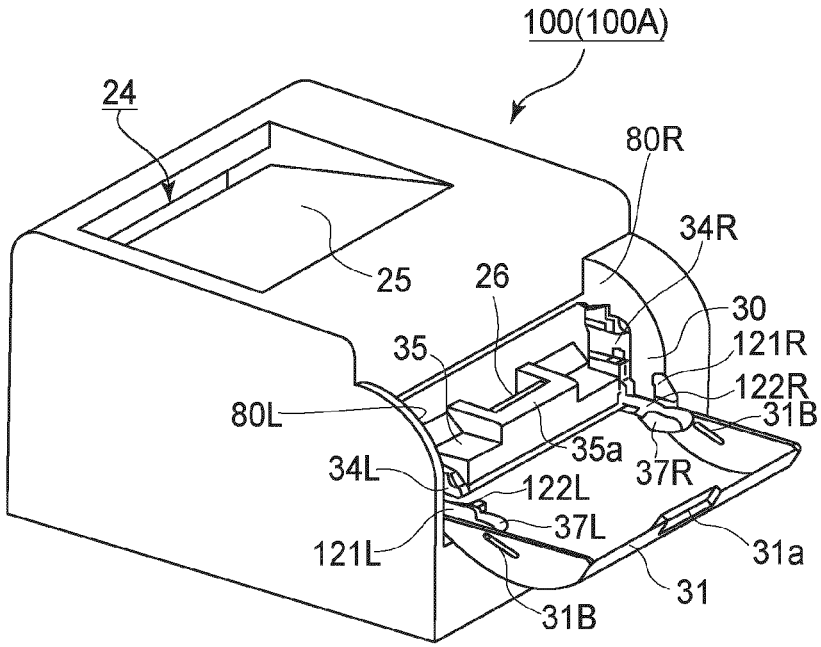
FIG. 3 is a perspective view of the outer appearance of the image forming apparatus, shown in FIG. 1, in which the front door is open.
Figure 4:
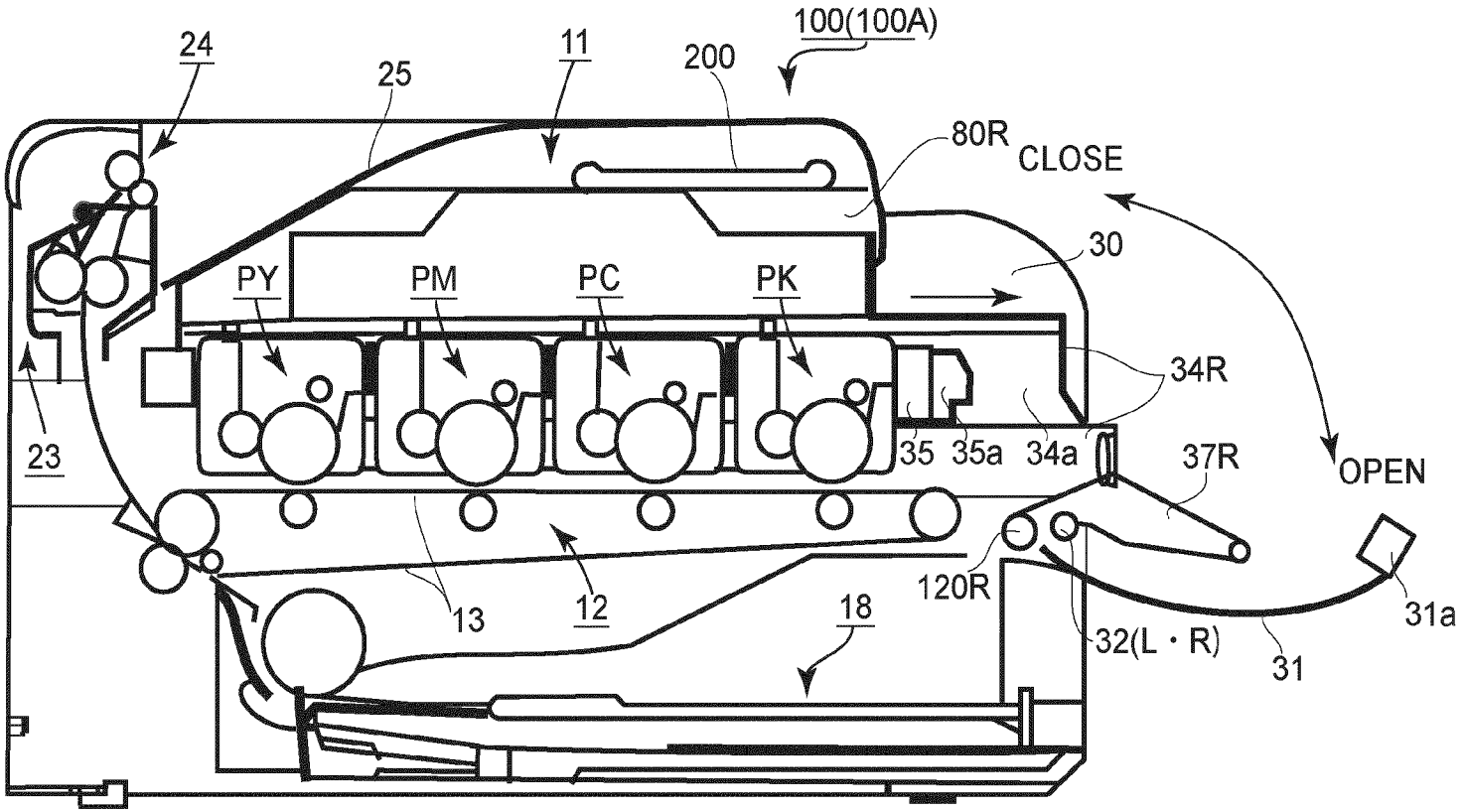
FIG. 4 is a longitudinal sectional view of the image forming apparatus, shown in FIG. 3, in which the front door is open, as seen from the left side of the apparatus main assembly.

This door 31 can be rotationally moved relative to the apparatus main assembly 100A about the horizontal shafts 32. That is, the door 31 is rotated about the horizontal shafts 32 so that it can be moved into the closed position (roughly vertical position) to cover (close) the opening 30 as shown in FIGS. 1 and 2, and also, so that it can be rotated frontward about the hinge shaft 32 into the open position (roughly horizontal position), as shown in FIGS. 3 and 4, to expose (open) the opening 30. To the door 31, a manual operating portion (finger placement portion) 31*a* for opening/closing the door 31 is provided.

Inside left and right frames SOL and SOR of the main frame of the apparatus main assembly 100A, a pair of tray holding members 34 (34L and 34R) are disposed, respectively. These holding members 34 oppose each other. A longitudinal (lengthwise) direction of each of the holding members 34 coincides with the front-rear direction of the apparatus main assembly 100A. Between the holding members 34, a cartridge tray (frame member) 35 is disposed. This tray 35 is held by the holding members 34 so that the tray 35 can be horizontally slid in the front-rear direction of the apparatus main assembly 100A. The tray 35 supports the cartridges P, i.e., is provided with mounting portions for removably mounting the plurality of cartridges P (PY, PM, PC, and PK), respectively.

Figure 6:
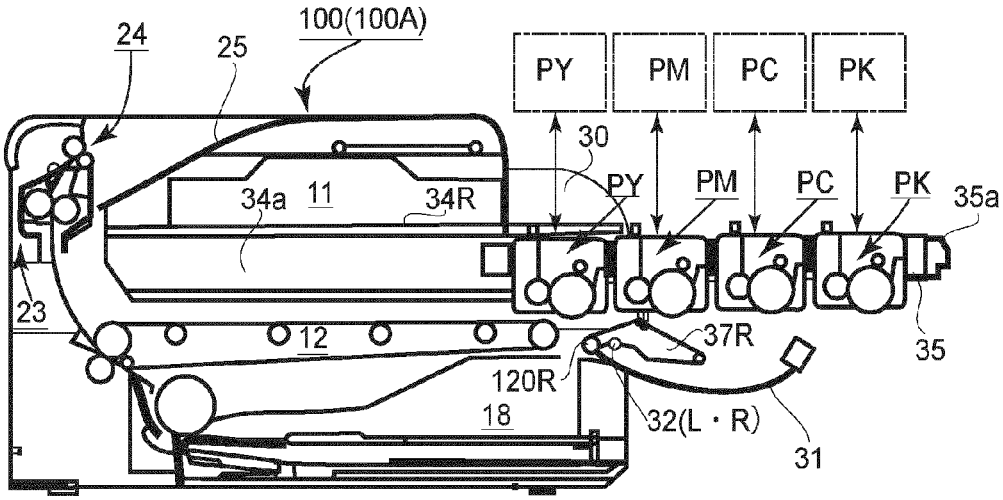
FIG. 6 is a vertical sectional view of the image forming apparatus, shown in FIG. 4, the cartridge tray of which is further pulled out from a state of FIG. 4, as seen from the left side of the apparatus.

In interrelation with the opening of the door 31, the holding members 34 (34L and 34R) are moved both frontward and upward of the apparatus main assembly 100A by predetermined distances. That is, the holding members 34 are moved from a first position to a second position. Here, the first position is a position of the holding members 34 for moving the tray 35 to a transfer contact position described later (FIG. 2), and the second position is a position of the holding members 34 for moving the tray 35 between a push-in position and a pull-out position (FIGS. 4 and 6). The push-in position is a position in which the tray 35 is pushed in the inside of the apparatus main assembly 100A (FIG. 4). The pull-out position is a position in which the tray 35 is pulled out to the outside of the apparatus main assembly 100A and the cartridges P are removably mountable to the above-described mounting portions (FIG. 6). The movement direction of the tray 35 is perpendicular to an axial direction of the drum 1 of each cartridge P (the longitudinal direction of the cartridge P). The holding members 34 are moved from the first position to the second position, whereby front portions thereof are projected frontward by a predetermined distance (FIGS. 3 and 4). An interrelating mechanism between the door 31 and holding members 34 will be described later.

In interrelation with the movement of the holding members 34 from the first position to the second position, drive output portions on the apparatus main assembly side are disengaged from corresponding drive input portions of each cartridge P (driven portion disengagement). Further, the pressure applied to each cartridge P by a pressing member to position and fix the cartridge is removed (pressure removal). Further, electrical conduction of an electric energy supplying system on the apparatus main assembly side to electrical contacts of each cartridge is ceased (electrical disengagement). Further, the positioning fixation of the tray 35 is released.

As described above, when the holding members 34 are moved from the first position to the second position, the tray 35 and each of the cartridges P are also moved upward together with the holding members 34 (FIG. 4). That is, the tray 35 is moved from the transfer contact position (FIG. 2) in which the drum 1 and the belt 13 contact each other to the transfer separation position (push-in position) (FIG. 4) in which the drum 1 and the belt 13 are separated from each other.

Figure 5:
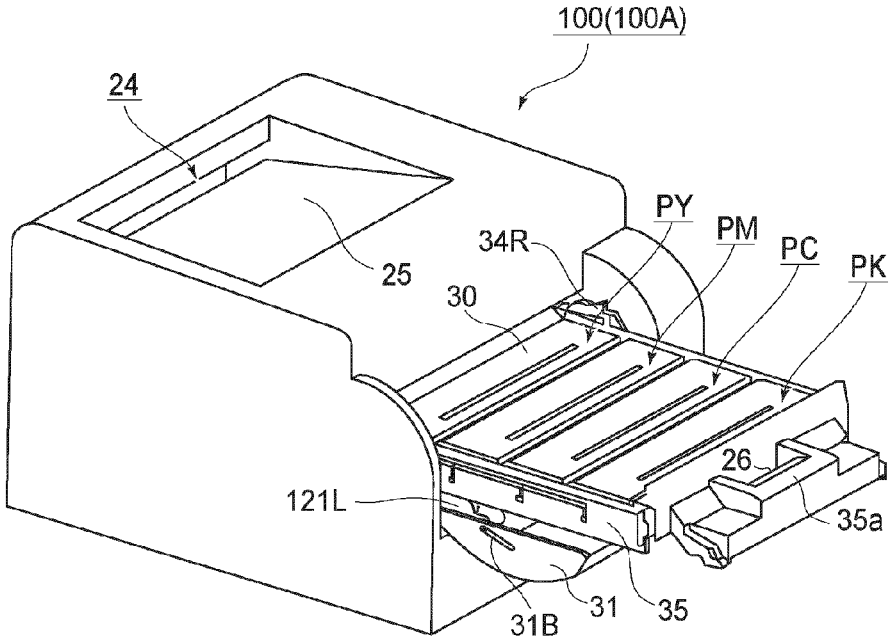
FIG. 5 is an outer appearance perspective view of the image forming apparatus, shown in FIG. 1, the cartridge tray of which is further pulled out from a state of FIG. 3.

Next, the entire four cartridges P held by the tray 35 pass through the opening 30 and are pulled out to the outside of the apparatus main assembly 100A (FIGS. 5 and 6). That is, the tray 35 is moved from the push-in position (FIG. 4) to the pull-out position (FIG. 6). Thus, upper (top) surfaces of all the cartridges P are exposed.

When the tray 35 is pulled out by a preset predetermined distance which is sufficient to expose all the cartridges, it is prevented by an unshown stopper portion from being pulled out further. The tray 35 is held in this horizontally pulled out position by the holding members 34.

The tray 35 supports individual cartridge P so as to be detachably movable directly above. As shown by chain double-dashed lines in FIG. 6, a spent cartridge P to be replaced is raised and removed above from the tray 35. Then, a new cartridge P is mounted on a mounting portion of the tray 35 and the tray 35 is moved from the pull-out position to the push-in position. Thereafter, the door 31 is closed. In interrelation with the closing of the door 31, the holding members 34 are moved from the second position to the first position, so that the tray 35 is moved from the push-in position to the transfer contact position. In interrelation with movement of these holding members 34, each cartridge P is pressed by a pressing member to be fixed at a predetermined positioning portion. As a result, a lower surface of the drum 1 of each cartridge P contacts a predetermined position of the belt 13. Further, the drive output portion of the apparatus main assembly 100A is connected to the drive input portion of the cartridge P. Further, the electric energy supplying system of the apparatus main assembly 100A is electrically connected to the electrical contacts of the cartridge P.

In the case of a cartridge having an openable drum cover (not shown) for protecting the lower surface of the drum 1, the cartridge may be configured so that the drum cover is closed manually after the cartridge is removed from the tray 35 and is opened manually before the cartridge is placed on the tray 35. The cartridge may also be configured so that the drum cover is closed automatically during upward raising of the cartridge from the tray 35 and is closed automatically during mounting of the cartridge on the tray 35 from above.

In summary, the tray 35 is locatable in the pull-out position in which the cartridge P is detachably mountable to the tray 35 at the outside of the apparatus main assembly 100A, the push-in position in which the cartridge P is pushed in the inside of the apparatus main assembly 100A, and the transfer contact position in which the drum 1 contacts the belt 13.

Further, the left and right holding members 34 (34L and 34R) are holding members for supporting the tray 35. The holding members 34 are locatable in the first position for positioning the tray 35 in the transfer contact position and the second position for moving the tray 35 between the pull-out position and the push-in position.

(Cartridge)

Figure 7:
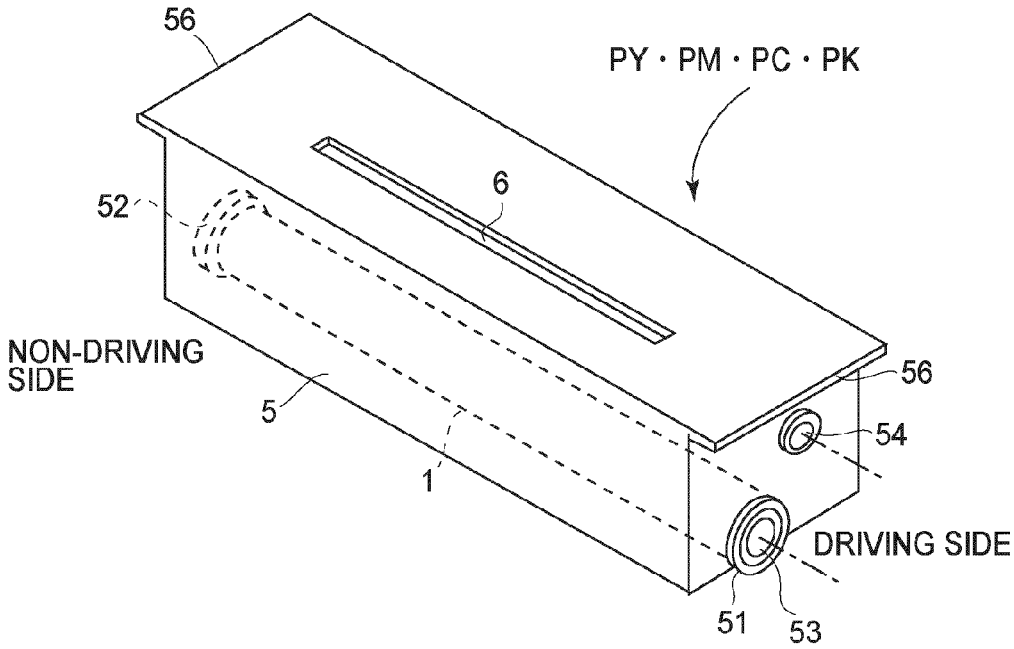
FIG. 7 is an outer appearance perspective view of the cartridge, as seen from the side from which the cartridge is driven.
Figure 8:
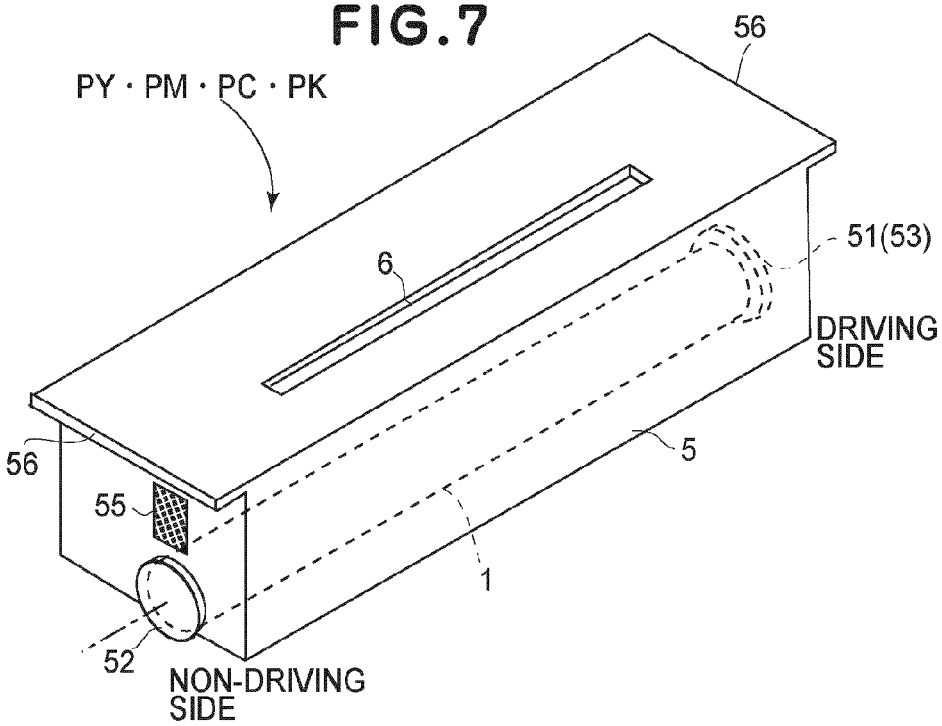
FIG. 8 is an outer appearance perspective view of the cartridge, as seen from the side from which the cartridge is not driven.

FIGS. 7 and 8 are perspective views of the outer appearance of each cartridge P, as seen from the side from which the cartridge P is driven, and the side from which the cartridge P is not driven, respectively.

In this embodiment, the leftward or rightward direction of the cartridge P is the direction parallel to the axial line of the drum 1. Each cartridge is an assembly of an elongated rectangular box type, the longitudinal (lengthwise) direction of which coincides with the above-mentioned leftward or rightward direction. The drum 1 is rotatably supported by a pair of bearing portions 51 and 52 disposed between the right and left side surface portions of the cartridge frame 5. The right bearing portion 51 is provided with a coupling engaging portion 53 as the drum drive input portion. Further, the right side surface portion of the frame 5 is provided with a coupling engaging portion 54 as a developing drive input portion for driving developing roller 3*a*. The left side surface portion of the frame 5 is provided with electrical contacts 55 of the cartridge. At each of the left and right side surface portions of the frame 5, an overhang 56 of a top plate portion of the frame 5 is provided and projected in the left-right direction. At an upper surface of the frame 5, an exposure window extending in a left-right direction as a longitudinal direction is provided. With respect to each cartridge P, the right-hand side on which the coupling engaging portions 53 and 54 are provided is a drive side, and the left-hand side opposite from the right-hand side is a non-drive side.

(Tray)

Figure 9:
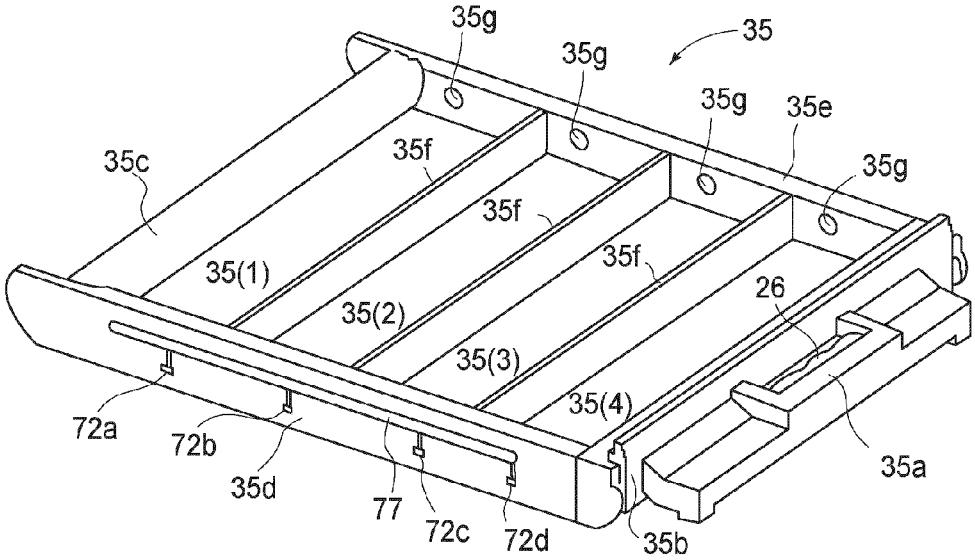
FIG. 9 is a perspective view of the cartridge tray.

FIG. 9 is a perspective view of the outer appearance of the tray 35. The tray 35 has a rectangular main frame, which is partitioned into four sub-spaces of substantially the same size by three partition plates 35*f* which extend in the left-right direction. Thus, first-fourth elongated sub-spaces 35(1)-35(4) are formed from the rear frame 35*c* side toward the front frame 35*b*. These sub-spaces 35(1)-35(4) are portions for holding the first to fourth cartridges PY, PM, PC and PK, respectively. Provided for the right frame 35*e* for the sub-spaces 35(1)-35(4), are four holes 35*g*, each for allowing a developing drive coupling 35*g* to move into, or out of, the corresponding sub-space.

Further, the tray 35 is provided with intermediary electrical contacts 72*a*-72*d* each for being electrically connected with the electrical contact 55 (FIG. 8) of the corresponding cartridge P. These intermediary electrical contacts 72*a*-72*d* are electrically connectible to main assembly-side electrical contacts 75*a*-75*d* (FIGS. 21 and 22) provided to a left frame 80L of the apparatus main assembly 100A. These electrical contacts will be described later.

Each cartridge P is to be inserted from above into the corresponding sub-space of the tray 35, so that the left and right overhangs 56 are caught, by their bottom surface, by the top surfaces of the left and right frames 35*d* and 35*e* of the tray 35. By this, each cartridge is supported by the tray 35. That is, the tray 35 supports each cartridge P so that the cartridge P can be removed from the tray 35 from directly above. The tray 35 roughly supports each cartridge P. By this constitution, it is possible to easily replace each cartridge P. The left and right frame 35*d* and 35*e* of the tray 35 are engaged with guide grooves 34*a* which are provided at inner surfaces of the left and right holding members 34L and 34R, respectively, and extend in the front-rear direction of the tray 35. By this, the tray 35 is supported by the left and right holding members 34L and 34R, and is slidable along the guide grooves 34*a* in the front-rear direction (horizontal direction) with respect to the holding members 34.

(Interrelating Mechanism Between Door 31 and Tray Holding Members 34 and First Regulating Member)

An interrelating mechanism between the door 31 and the tray holding members 34 and a first regulating member will be described with reference to FIGS. 10-15, 17, 18, 21 and 23.

Figure 10:
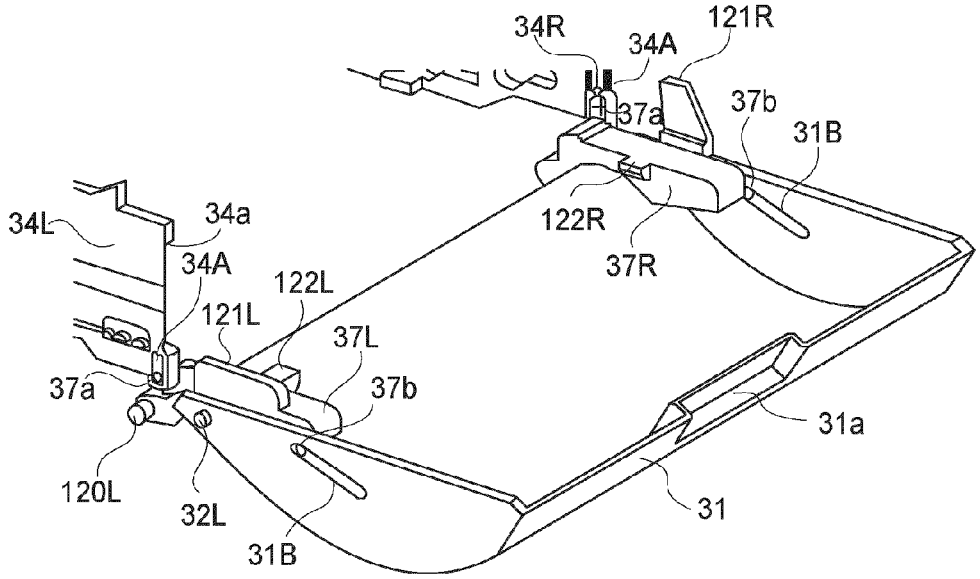
FIG. 10 is a perspective view of an interrelating mechanism portion between a door and tray holding members.
Figure 23:
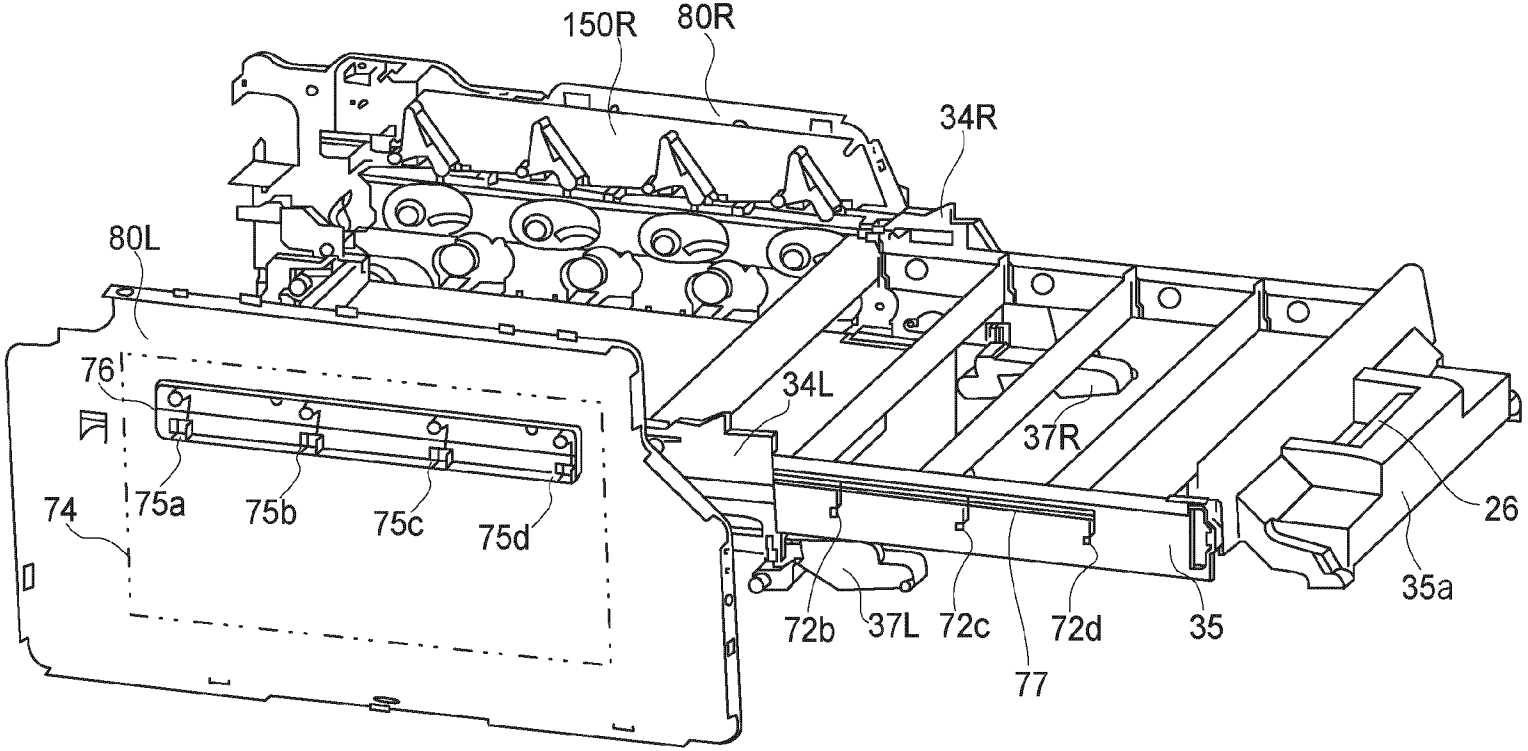

FIG. 10 is a perspective view of an interrelating mechanism portion between the door 31 and the holding members 34. Left and right hinge portions 32 (32L and 32R) of the door 31 are horizontally disposed with respect to the left-right direction of the apparatus main assembly 100A. These hinge portions 32 are rotatably supported by bearing members (not shown) provided on left and right sides of the apparatus main assembly 100A, respectively. These bearing members may also be left and right frames 80L and 80R (FIG. 23).

Further, at left and right end portions of the door 31, connecting arms 37 (37L and 37R) are disposed. In this embodiment, the door 31 and the connecting arms 37 are separate members. These connecting arms 37 interrelate the door 31 with the holding members 34. Hinge portions 120 (120L and 120R) provided to the connecting arms 37 are horizontally disposed with respect to the left-right direction of the apparatus main assembly 100A. These hinge portions 120 are rotatably supported by bearing members (not shown) provided left and right portions of the apparatus main assembly 100, respectively. These bearing members may also be the left and right frames 80L and 80R. The arms 37L and 37R are provided with horizontal shafts 37*a* and 37*b*, respectively. The horizontal shaft 37*a* of the left connecting arm 37L is engaged in a vertically elongated hole 34A provided to the bottom front portion of the left holding member 34L. Further, the horizontal shaft 37*b* of the left connecting arm 37L is engaged in a groove 31B provided to the left side surface portion of the door 31. The horizontal shaft 37*a* of the right connecting arm 37R is engaged in a vertically elongated hole 34A provided to the bottom front portion of the right holding member 34R. Further, the horizontal shaft 37*b* of the right connecting arm 37R is engaged in a groove 31B provided to the right side surface portion of the door 31.

That is, the door 31 and the holding members 34 are connected to each other via the connecting arms 37. By this, in interrelation with the opening/closing of the door 31, the connecting arms 37 are rotationally moved. By this, a moving force in the front-rear direction acts on the left and right holding members 34.

The hinge portions 120 of the connecting arms 37 may be disposed coaxially with the hinge portions of the door 31. Further, without providing the connecting arms 37, the door 31 and the holding members may also be directly connected to each other.

Figure 11:
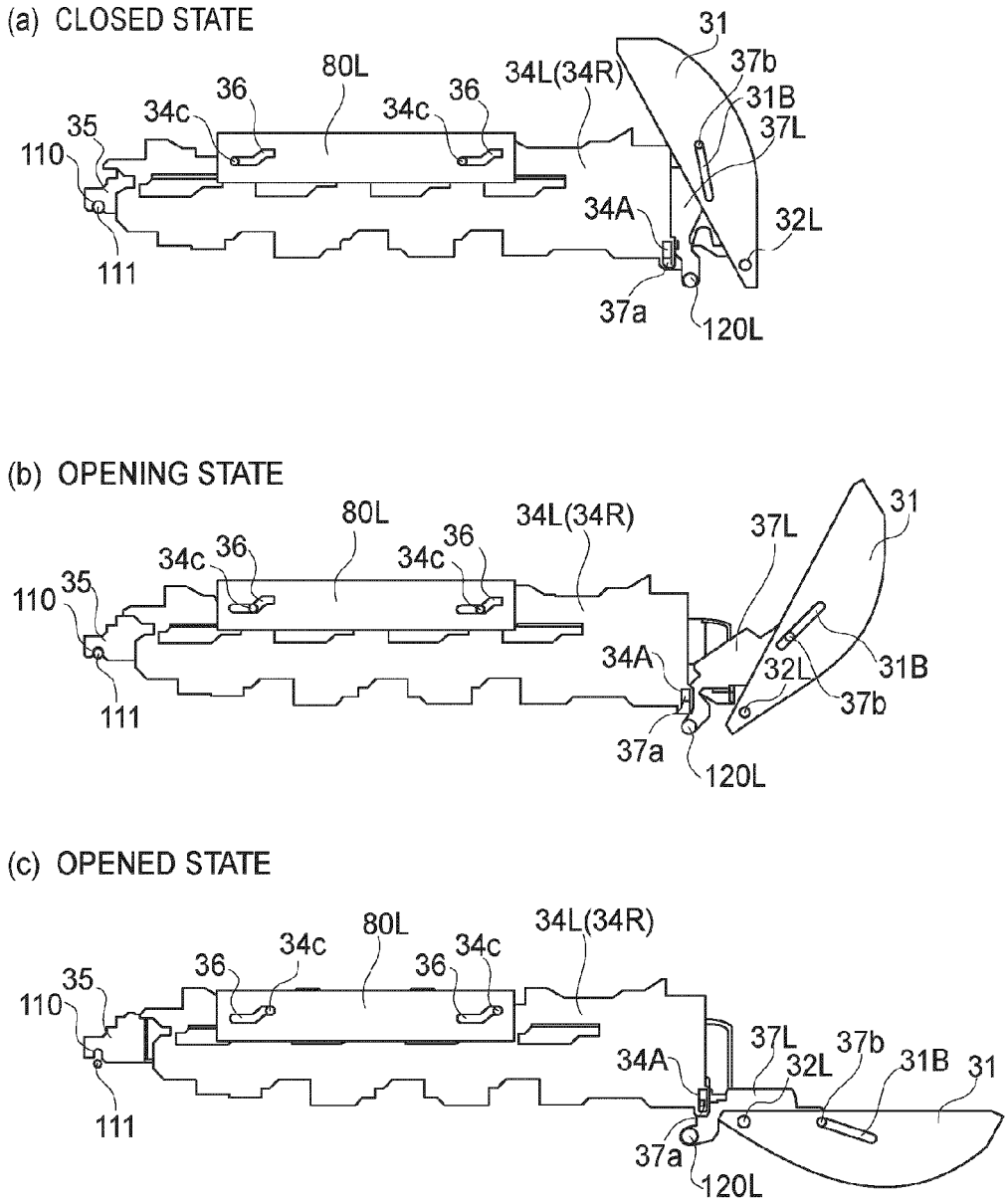
FIGS. 11(*a*) to 11(*c*) are schematic views each for illustrating movement of the tray holding member in interrelation with rotational door movement of the door.
Figure 12:
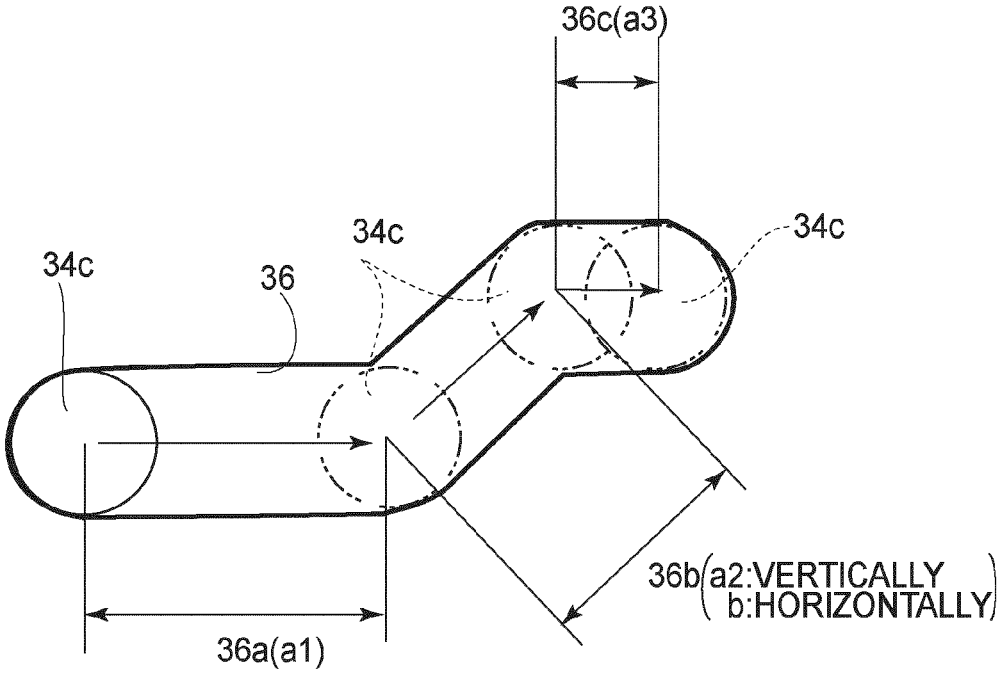
FIG. 12 is an enlarged view of a guiding hole portion.

As shown in FIGS. 11(*a*) to 11(*c*) and FIG. 12, each of the left and right holding members 34 is provided with two pins 34*c* which are disposed with a spacing with respect to the front-rear direction. These pins 34*c* are engaged in the guide holes 36 provided to the left and right frames 80 (80L and 80R) of the apparatus main assembly 100A. By the engagement of each pin 34*c* in a corresponding guide hole 36, the holding members 34 are supported by the left and right frames 80, respectively.

Each of FIGS. 11(*a*) to 11(*c*) shows the two pins 34*c* of the left holding member 34L, and the guide holes 36 of the left frame 80L. It does not show the right holding member 34R. But, the right holding member 34R is the same as the left holding member 34L, except that its pins 34*c* and the corresponding guide holes 36 of the left frame 80L are symmetrically positioned relative to those of the left holding members 34L and the corresponding guide holes 36.

Therefore, the left and right holding members 34 are movable relative to the left and right frames 80, within a guide range set by the guide holes 36.

FIG. 12 is an enlarged view of one of the guide holes 36. Each guide hole 36 includes first, second, and third guiding sections 36*a*, 36*b*, and 36*c*. The first guiding section 36*a* is a horizontal section parallel to the front-rear direction of the apparatus main assembly 100A. The second guiding section 36*b* extends frontward from the front end of the first section 36*a*, slanting upward. The third guiding section 36*c* extends frontward from the front end (top portion) of the second guiding section 36*b* and is a horizontal section parallel to the front-rear direction of the apparatus main assembly 100A. The third guiding section 36*c* can stably hold the pin 34*c*.

The pins 34*c* (the holding members 34) are moved by a distance a1, in interrelation with the opening of the door 31, in the horizontal direction along the first guiding section 36*a* (first movement), and then, are moved slantingly upward (in the horizontal direction by a distance a2 and in a vertical direction by a distance b) along the second guiding section 36*b* (second movement). Then, finally, they are moved in the horizontal direction by a distance a3 along the third guiding section 36*c* (third movement). The vertical direction is a direction in which the drum 1 and the belt 13 contact with and separate from each other.

FIG. 11(*a*) shows a state in which the door 31 is completely shut against the apparatus main assembly 100A. In this state, the left and right holding members 34 have been pushed in their rearmost positions in the apparatus main assembly 100A via the hinge shaft 32, the connecting arms 37, the horizontal shafts 37*a*, and the vertically elongated holes 34*b*. Further, each pin 34*c* is located at the rear end of the first guiding section 36*a* of the guide hole 36. Therefore, the left and right holding members 34 are held in the first position. The tray 35 which is held by the holding members 34 located in the transfer contact position.

Each of the cartridges P held in the tray 35 is under the pressure applied to its left and right upper surface portions by the above-mentioned pressing member. Thus, the lower surface portion (by which the cartridge is positioned) of the bearing 51 on the drive side, and the bottom lower surface portion (by which the cartridge is positioned) of the bearing 52 on the non-drive side, are fixed at the positioning portions provided to the stay members (inner side plates) of the apparatus main assembly 100A. Thus, each cartridge P is positioned relative to the apparatus main assembly 100A. In this state, the lower surface of the drum 1 in each cartridge P stably contacts the upper surface of the belt 13.

The cartridge engaging portions 53 and 54 of each cartridge P are placed in a state in which the drum drive coupling and the development drive coupling of the apparatus main 100A are engaged therein, respectively.

To the electrical contacts 55*a*-55*d* of each cartridge P, electric power can be supplied from the apparatus main assembly 100A through the corresponding intermediary electrical contacts.

Figure 17:
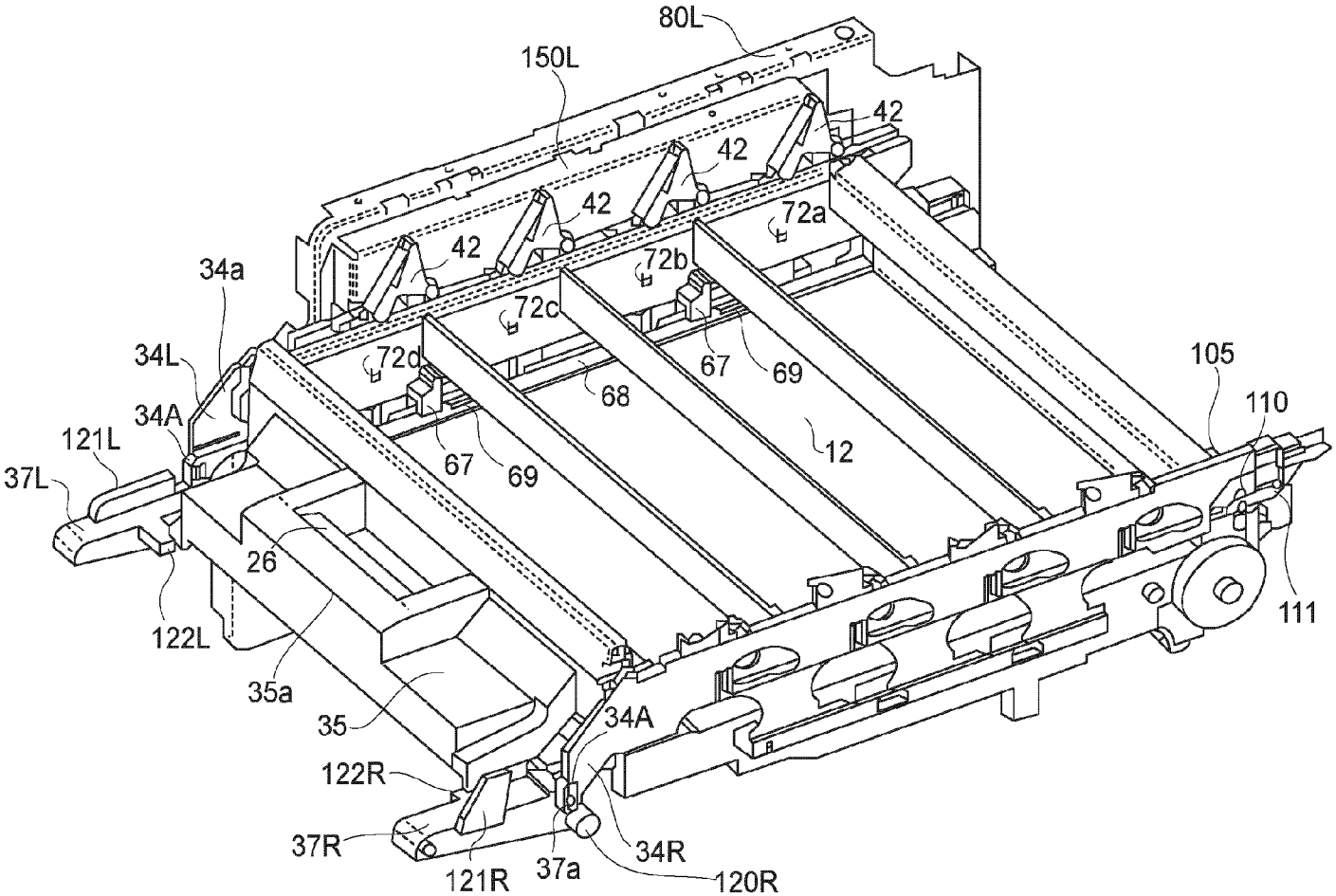
FIGS. 17 and 18 are perspective views each for illustrating a first regulating member (position regulating means) for the tray.
Figure 18:
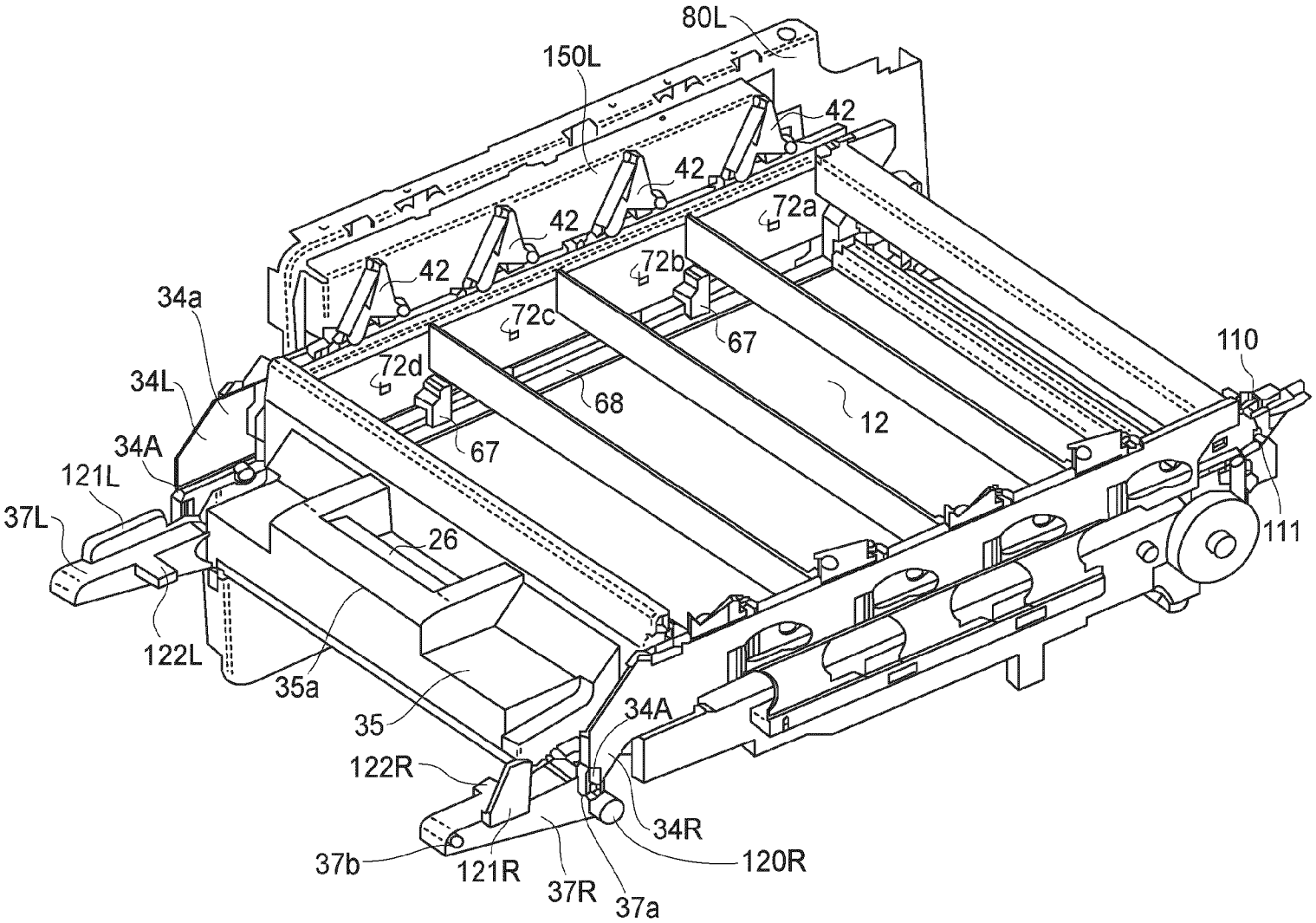
Figure 21:
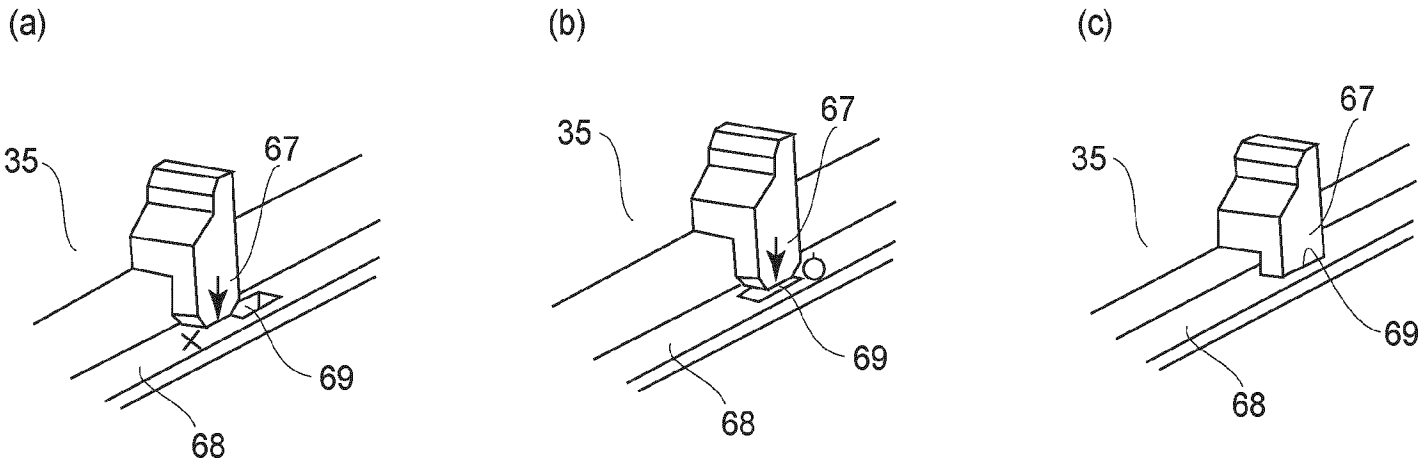
FIGS. 21(*a*), (*b*) and (*c*) are enlarged views each for illustrating the first regulating member for the tray.

On the right side of the tray 35, a downward U-shaped groove 110 is provided. This U-shaped groove 110 engages with a pin 111 fixed to the right frame 80R of the apparatus main assembly 100A. By this, the right side of the tray 35 is positioned to the apparatus main assembly 100A. On the left side of the tray 35, downward projections 67 are provided (FIGS. 17, 18 and 21). A lower end portion of each projection 67 is engaged in a hole 69 provided to an intermediary transfer belt holding member 68 fixed to the apparatus main assembly 100A, so that the left side of the tray 35 is positioned to the apparatus main assembly 100A. The positioning means for positioning the tray 35 may also be only one of the above-described left and right means.

FIG. 11(*b*) shows a state in which the door 31 is partially opened. As the door 31, which is in the closed state as shown in FIG. 11(*a*), is opened, holding members 34L and 34R are pulled frontward, in the apparatus main assembly 100A, in interrelation with the opening of the door 31. By this, the holding members 34 are moved frontward by the distance a1, since the pins 34*c* are guided by the first guiding section 36*a* of the guide hole 36. FIG. 11(*b*) shows this state. While the left and right holding members 34L and 34R are moved by the distance a1 as described above, the drum drive coupling and the development drive coupling of each cartridge P are disengaged. Further, the pressure applied to each cartridge P by the pressing member to position the cartridge is removed. At this time, the pins 111 and the projections 67 are engaged with the U-shaped hole 110 and the holes 69, respectively, so that the tray 35 is prevented from following the horizontal movement of the holding members 34.

Then, in interrelation with the opening of the door 31, the holding members 34 are pulled frontward further in the apparatus main assembly 100A. By this, the holding members 34L and 34R move in the slanting upward direction, with the pins 34*c* being guided by the second guiding section 36*b* of the guiding hole 36. During this slantingly upward movement of the holding members 34, the electrical contacts 55 of each cartridge P are electrically disconnected from the counterparts on the apparatus main assembly 100A.

Figure 13:
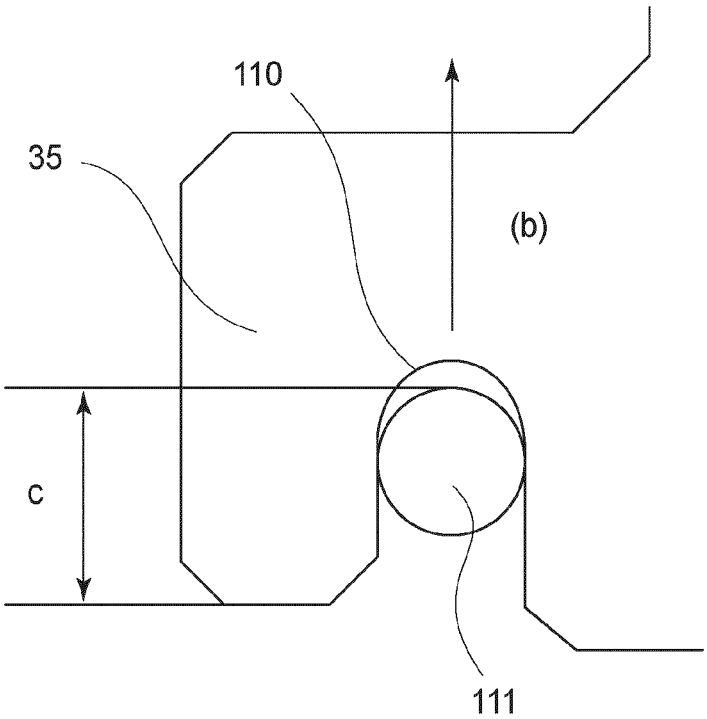
FIG. 13 is an enlarged view of a pin portion as a tray regulating member, and a U-shaped groove portion.

Referring to FIG. 13(*a*), the distance by which the pin 101 enters U-shaped groove 110 is denoted as c. Further, a distance by which the U-shaped groove 110 is vertically displaced by the movement of the holding members 34 in the slantingly upward direction is denoted as b. During this slantingly upward movement of the holding member 34, as long as the U-shaped groove 110 is engaged with the pin 111 (c>b), the U-shaped groove 110 (tray 35) follows only the movement of the holding members 34 in the vertical direction. Then, in a state in which the holding members 34 are displaced upward to a certain degree (c≦b), the pin 111 comes out of the U-shaped groove 110, so that the tray 35 is horizontally movable. By employing such a constitution, in a state in which the lower surface of the drum 1 of each cartridges P held in the tray 35 is in contact with the belt 13, the tray 35 does not horizontally move. Therefore, it is possible to prevent the occurrences of damage and memory caused by rubbing between the drum 1 and the belt 13. It is also possible to employ a similar constitution with respect to a distance by which the projection 67 provided on the left side of the tray 35 enters the hole 69 provided to the belt holding member 68.

FIG. 11(*c*) shows a state in which the door 31 is completely opened. In this state, the holding members 34 have finished their slantingly upward movement effected by the second guiding section 36*b*, so that the pins 34*c* are located in the horizontal third guiding section 36*c*. That is, the holding members 34 are held in a predetermined upper position (second position) with respect to the left and right frames 80. The reason for locating the pins 34*c* in the third guiding section 36*c* is to keep the cartridges P and holding members 34 stably in a position with respect to the vertical direction, and also, to prevent the holding members 34 from shifting rearward when replacing the cartridge(s) by pulling out the tray 35 from the holding members 34.

In the state shown in FIG. 11(*c*), the pin 111 has already come out of the U-shaped groove 110 and the projections 67 have already come out of the holes 69, so that the tray 35 is removed from the latent image forming position (transfer contact position).

However, in a state in which the holding members 34 are moved from the first position to the second position, the tray 35 held by the holding members 34 is regulated so as not to move from the push-in position toward the pull-out position.

The above-described groove 110 and the pin 111 are regulated and the projections 67 and the holes 69 are regulated, so as not to move the tray 35 toward a direction perpendicular to a direction in which the drum 1 of the cartridge P and the belt 13 contact each other when the tray 35 is located in the transfer contact position. The regulating members 110, 111, 67 and 69 release the tray 35 from movement regulation after the tray 35 follows the movement of the belt 13 and the drum 1 held by the holding member 34 in a separation direction (upward direction) in which the drum 1 is separated from the belt 13.

That is, the holding members 34 effect the above described first movement, second movement, and third movement in interrelation with the opening of the door 31. The holding members 34 disconnect the driving means during the first movement and the tray 35 follows the movement of the holding members 34 by the vertical movement of the holding members 34 (second movement), and thereafter the first regulating members 110, 111, 67 and 69.

In this state, the tray 35 slides and moves in the front-rear direction of the holding members 34 and is locatable in the pull-out position in which the cartridge P is replaceable and the push-in position in which the cartridge P is pulled in the inside of the apparatus main assembly 100A.

Figure 15:
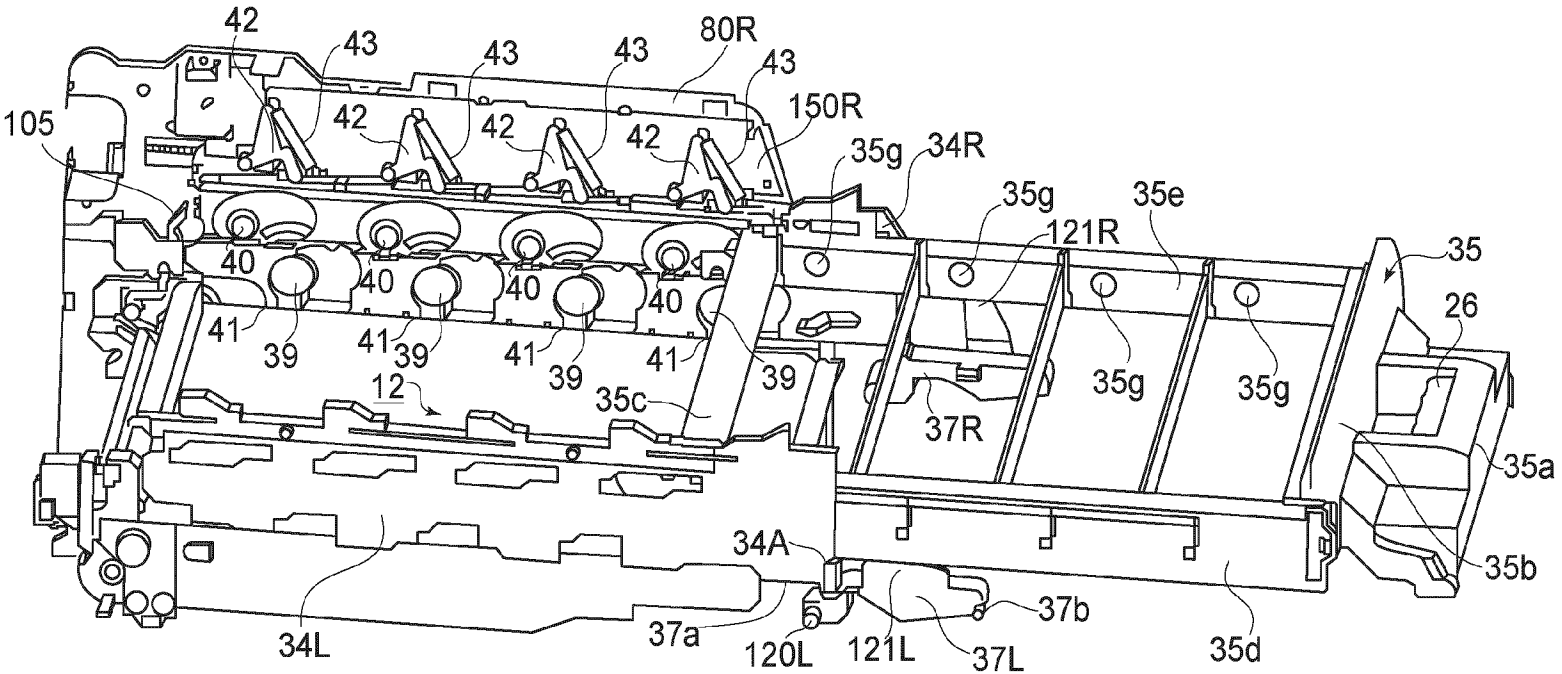

FIG. 15 is a perspective view showing a state in which the tray 35 is pulled out to a position in which the cartridge P is replaceable. The connecting arms 37 (37L, 37R) as the tray supporting member have tray supporting portions 121 (121L, 121R). The tray supporting portions 121 support the tray 35 located in the pull-out position.

That is, the connecting arms 37 for interrelating the door 31 with the holding members 34 also function as the supporting member for supporting the tray 35 when the tray 35 is located in the pull-out position. By this, it is possible to prevent the surface of the drum 1 from being damaged by downward large bending of a front portion of the tray 35 by the weight of the tray 35 and the cartridges P and to prevent the apparatus main assembly 100A from toppling over by becoming out-of-balance in weight as a result of pulling-out of the tray 35.

The tray supporting members 121 also function as a guide portion during movement of the tray 35 between the pull-out position and the push-in position. By this, it is possible to stably and smoothly move the tray 35.

The connecting arms 37 are rotationally moved in interrelation with the door 31, so that the tray supporting portions 121 are located inside of the apparatus main assembly 100A when the door 31 is closed and located outside of the apparatus main assembly 100A when the door 31 is opened. By this, it is possible to stably hold the tray 35 in the pull-out position without upsizing of the apparatus main assembly 100A, thereby to improve usability when each cartridge P is replaced. Further, the connecting arms 37 (tray supporting members 121) have a maximum radius of rotation smaller than that of the door 31, so that it is possible to increase the rigidity of the connecting arms 37.

The shape and the number of supporting points of the tray supporting members for supporting the tray 35 in the pull-out position are not limited to those shown in FIG. 15. Further, the door 31 and the tray supporting members 121 may also be integrally provided.

By employing the above-described constitution, it is possible to provide an image forming apparatus of a cartridge pull-out type which has prevented the occurrence of damage and memory caused by rubbing between the belt 13 and the drum 1 of each cartridge P without increasing the size and cost of the apparatus main assembly 100A.

(Interface Portions)

Interface portions will be described with reference to FIGS. 1, 2, 5-7, 14-16, and 25.

Figure 14:
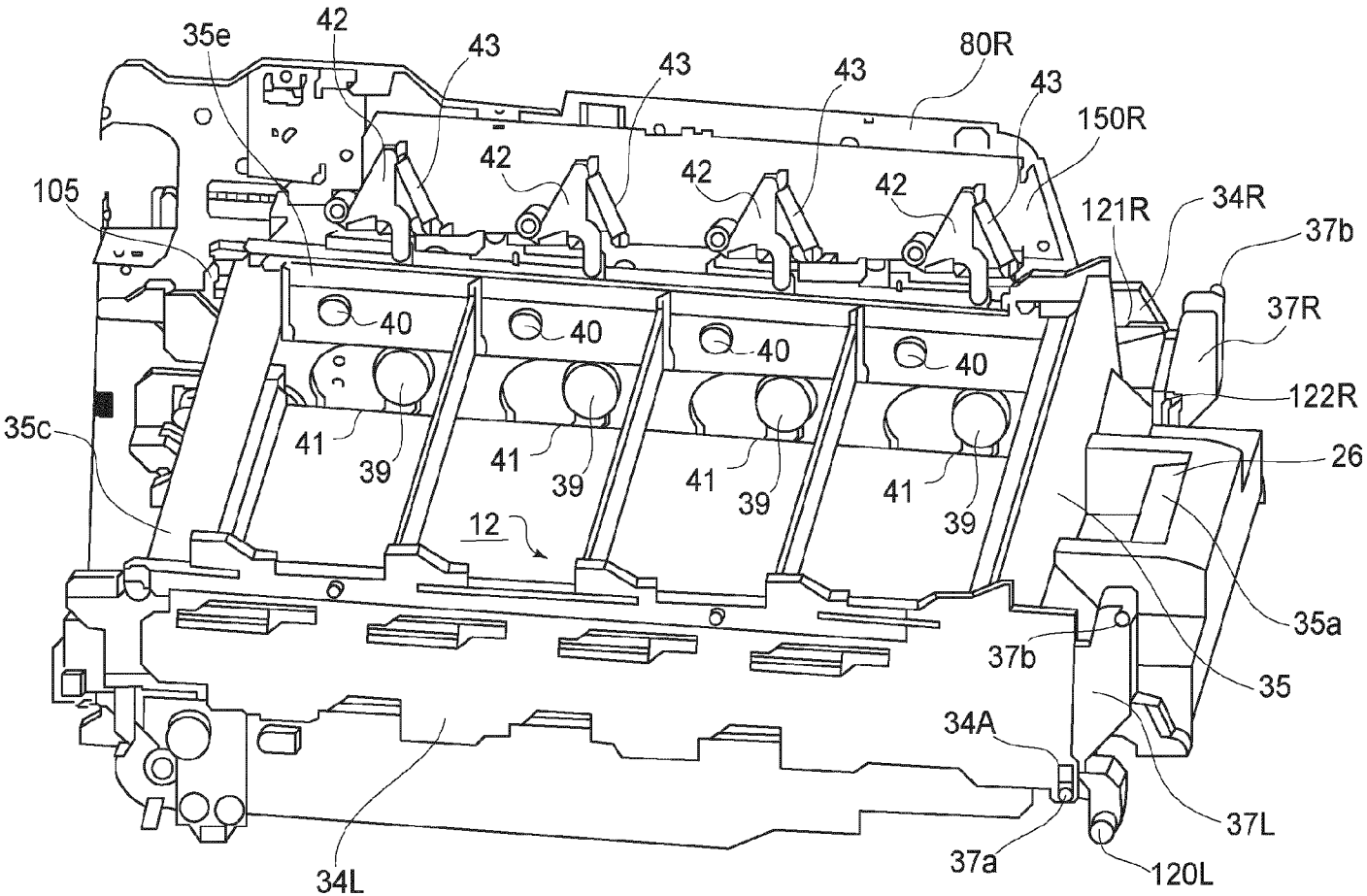
FIGS. 14, 15, and 16(*a*) and 16(*b*) are views each for illustrating interface portions, located adjacent to the cartridge, for releasing pressure application to and engagement with the cartridge in interrelation with the tray holding member.
Figure 16:
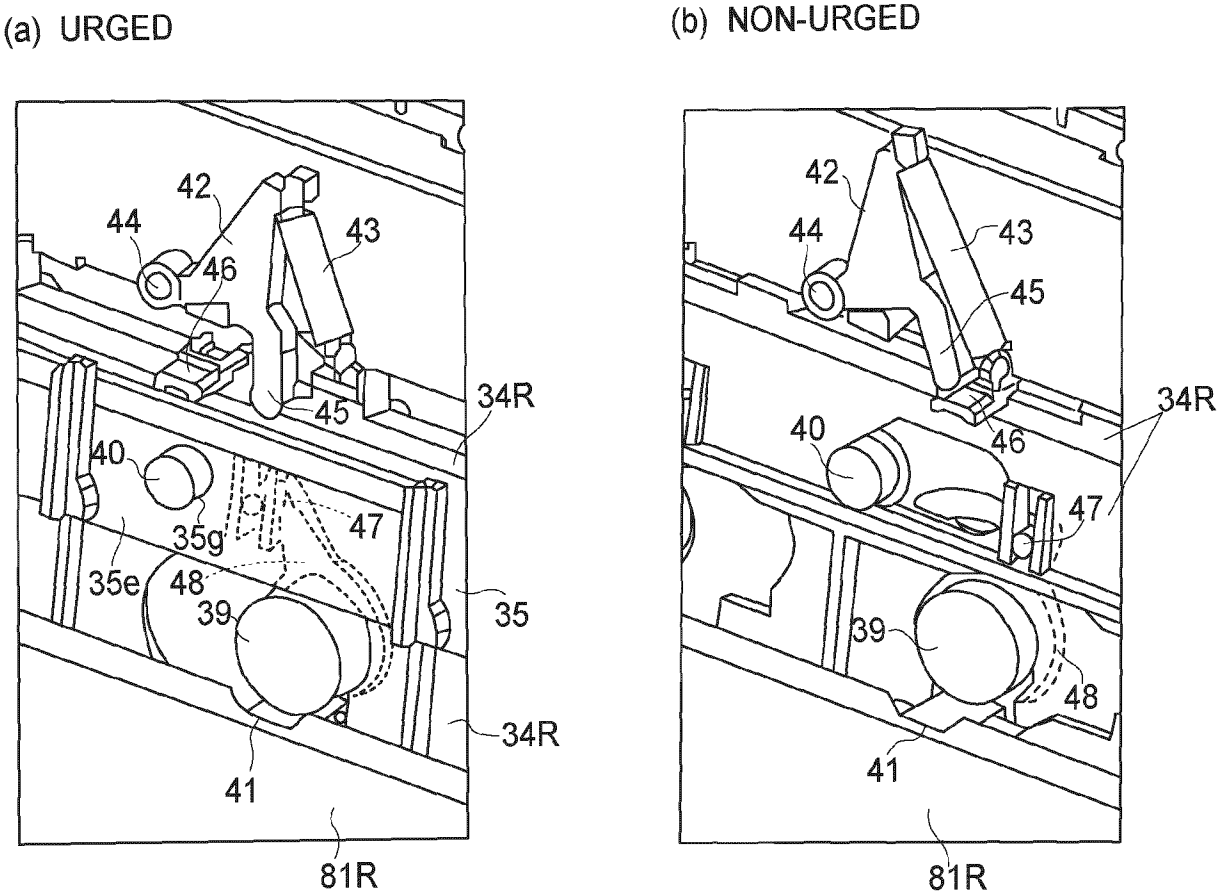

FIGS. 14-16 are schematic views for illustrating the interface portions in the neighborhood of each cartridge, which are interrelated with the tray holding members 34 (34L and 34R) to perform disengagement or a release operation.

FIG. 14 is a perspective view showing a state in which the door 31 is closed as shown in FIGS. 1 and 2, and no cartridge is in the tray 35. FIG. 15 is a perspective view showing a state in which the door 31 is opened as shown in FIGS. 5 and 6, and the tray 35 has been pulled out.

On the right side in the apparatus main assembly 100A, drum driving (force transmitting) couplings 39 and development (roller driving force transmitting) couplings 40 as the driving force output portions on the apparatus main assembly side, which are connected with the driving force input portions 53 and 54 (FIG. 7) on the cartridge side, in order to drive the drum 1 and the developing roller 3*a*, respectively, in each cartridge.

Figure 25:
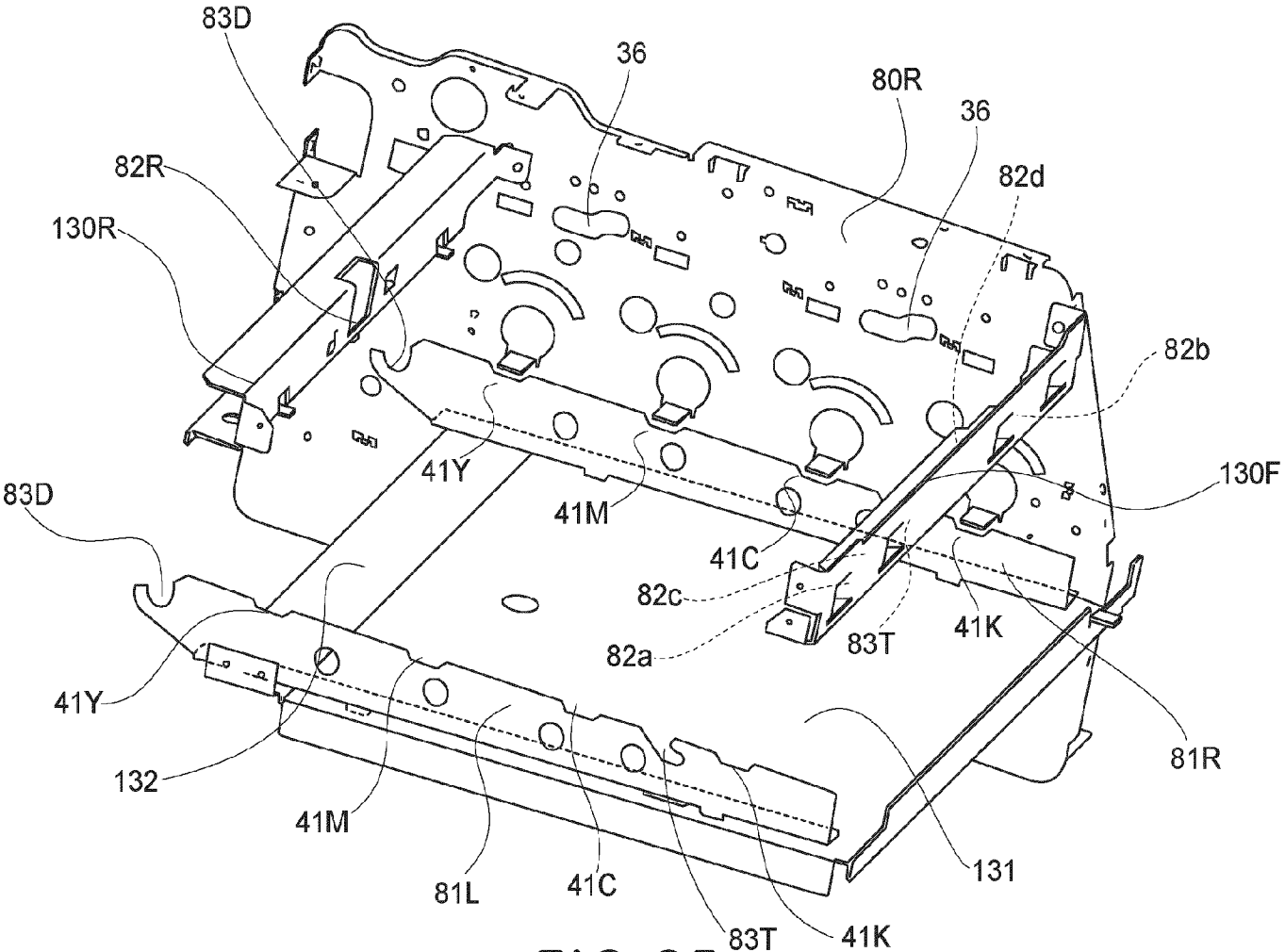
FIGS. 25 to 29 are schematic views each for illustrating a constitution of a stay member.

On both the left and right sides in the apparatus main assembly 100A, stay members 81L and 81R (FIG. 25) are provided. Further, cartridge positioning portions 41 (41Y, 41M, 41C, 41K) for receiving the lower surface portions of bearing portions 51 and 52 of each cartridge P are provided to the stay members 81L and 81R, respectively (FIG. 25).

Also on both the left and right sides in the apparatus main assembly 100A, pressing (urging) members 42 press (urging) the left and right side upper surfaces of the corresponding cartridge P so that the bearing portions 51 and 52 can be engaged and fixed in the cartridge positioning portions 41. Each pressing member 42 is provided with a spring for generating a pressing force.

FIG. 16(*a*) is an enlarged view of the pressing member 42, the drum driving coupling 39, and the development driving coupling 40, which are in the state shown in FIG. 14. FIG. 16(*b*) is an enlarged view of the pressing member 42, the drum driving coupling 39, and the development driving coupling 40, which are in the state shown in FIG. 15.

Each pressing member 42 is rotatably provided to the apparatus main assembly 100A with a supporting point 44, and urges (presses) the right (or left) end upper surface of the corresponding cartridge by a spring force of an urging (pressing) spring 43. In a non-urged (pressure-removed) state shown in FIG. 16(*b*), a lever portion 45 of the pressing member 42 has been pushed up by a pressing member raising portion 46 provided to the holding member 34R, so that the pressure applied to the cartridge is removed in interrelation with the movement of the tray holding member 34R.

Further, a release lever pin 47 is provided to a release lever 48 (means for removing a driving force transmitted to the cartridge) provided around the drum driving coupling 39 so as to retract the driving coupling 39. In interrelation with the movement of the holding member 34R, the release lever pin 47 is moved from the position shown in FIG. 16(*a*) to the position shown in FIG. 16(*b*). By the operation of the release lever 48, the drum driving coupling 39 and the development driving coupling 40 are retracted to the position shown in FIG. 16(*b*). That is, the drum driving coupling 39 and the development driving coupling 40 of each cartridge are disengaged from their counterparts on the apparatus main assembly side.

In the state shown in FIG. 15, that is in a state in which the drum driving couplings 39, the development driving coupling 40, and the pressing members 42 are disengaged, the tray 35 is slidable. Accordingly, the tray 34 is placed in such a state that it can be accommodated in and pulled out from the apparatus main assembly 100A while holding the cartridges P thereon.

As described above, the left and right holding members 34 are operated in interrelation with the opening or closing operation of the door 31. In this case, in order to reduce the amount of force necessary to open or close the door 31, the image forming apparatus may be structured so that the timing of the pressure removal is slightly different from the timing of the disengagement of the driving couplings.

That is, the drum driving coupling 39, the development driving coupling 40, and the pressing member 42 are rendered slightly different in disengagement timing. More specifically, the pin 47 and pressing member raising portion 46 are made different in position to render the drum coupler 39 and the pressing member 43 slightly different in disengagement (pressing) timing, and the four cartridges are rendered slightly different in disengagement (pressing) timing. By this, the load exerted on the door 31 is distributed. As a result, it is possible to reduce the peak load and reduce the operating force during operation of the door 31 by a user.

As described above, the retraction of the driving means (couplings 39 and 40) and the vertical movement of the tray 35 are performed by the movement of the holding members 34, so that it is possible to integrate the mechanisms to realize a compact size of the apparatus main assembly.

(Second Regulating Member and Urging Member for Tray)

The tray 35 in this embodiment has a tray ejection preventing claw 101 as a second regulating member. This preventing claw 101 is a regulating means (locking means) for regulating movement of the tray 35 from the push-in position. Further, an urging member 105 urges the tray 35 so as to push out the tray 35 from the push-in position toward the pull-out position by a predetermined distance in the case where the holding members 34 are located in the second position. By the preventing claw 101 and the urging member 105, the tray 35 is guided so as to be completely accommodated in the push-in position. The preventing claw 101 and the urging member 105 will be described with reference to FIGS. 11, 13, and 17-21.

Figure 19:
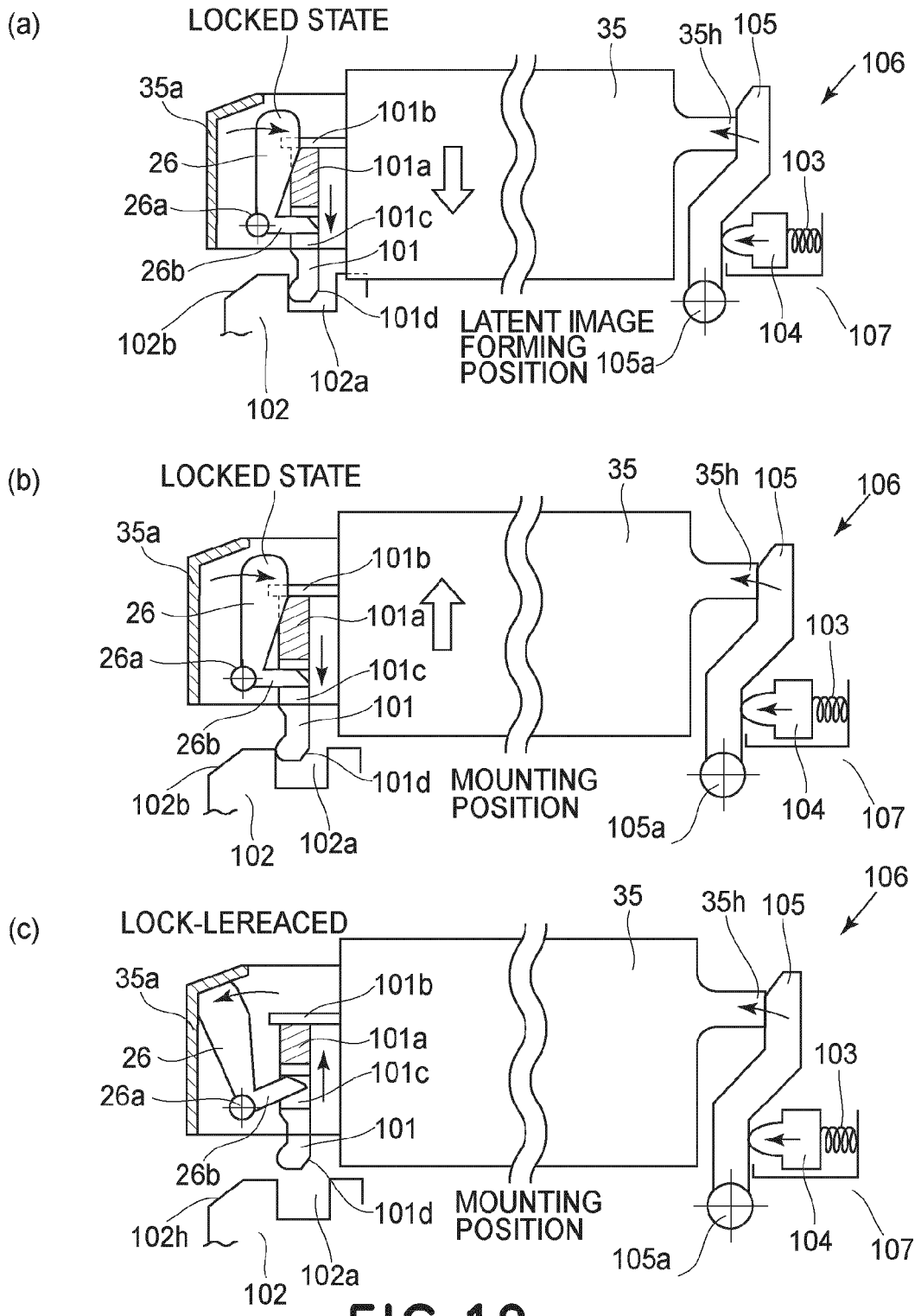
FIGS. 19(*a*) to 19(*g*) and FIGS. 20(*a*) and 20(*b*) are sectional views each for illustrating a second regulating member for the tray.
Figure 19:
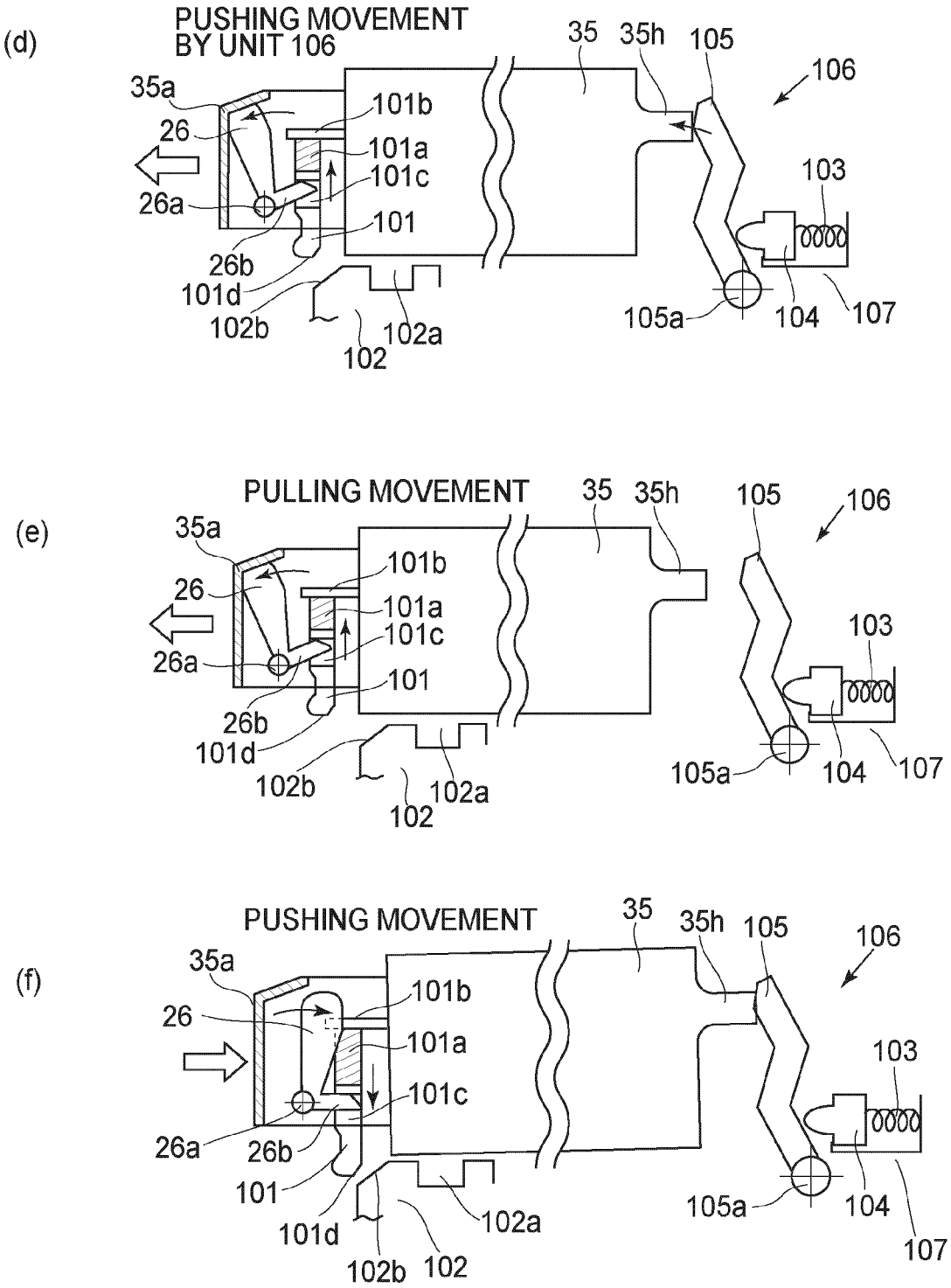
Figure 19:
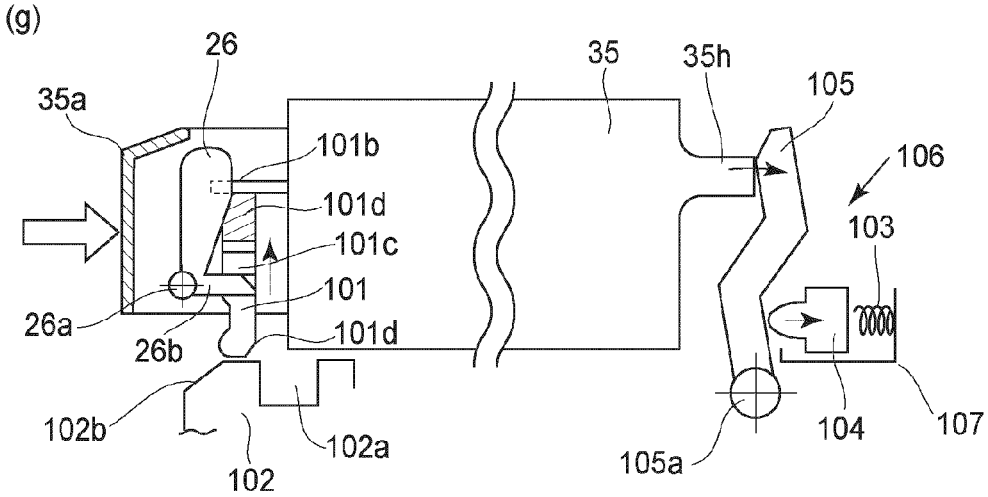

A description will be provided principally with reference to FIGS. 19(*a*) to 19(*g*). The preventing claw 101 is provided downward on the front side of the tray 35. The preventing claw 101 is vertically slidable in a predetermined stroke range. Further, the preventing claw 101 is urged downward by a spring 101*a*. The spring 101*a* is compressedly disposed between a spring-receiving seat 101*b* provided to the tray 35 and an upper end of the preventing claw 101. On the front side of the tray 35, a lever 26 as a manual operating portion and a fixed portion 35*a* as a holding portion are provided. Inside the fixed portion 35*a*, the lever 26 is swingably supported about a shaft portion 26*a*. The lever 26 has an arm portion 26*b* that is as a releasing portion. This arm portion 26*b* is engaged with a vertically elongated hole 101*c* provided to the preventing claw 101. In a free state, to the arm portion 26*b* of the lever 26, a downward urging force is applied at an upper end of the vertically elongated hole 101*c* of the preventing claw 101 downwardly urged by the spring. By this, the lever 26 is rotationally moved about the shaft portion 26*a* in a clockwise direction to be placed in a selected state at an inside of the fixed portion 35*a*. To a fixing member 102 fixed to the apparatus main assembly 100A, a recess 102*a* as a portion to be engaged with a lower end portion of the preventing claw 101 is provided.

On the rear side in the apparatus main assembly 100A, an urging unit 106 for urging the tray 35 is provided. The urging unit 106 includes an urging member 105, which urges the tray 35, when the holding members 34 are located in the second position, from the push-in position toward the pull-out position (toward the front of the apparatus main assembly 100A) so that the tray 35 is pushed back by a predetermined distance. The urging member 105 is a lever for urging the tray 35 from the push-in position toward the pull-out position by contact at its upper portion with a portion to be urged 35*h* disposed at a rear end of the tray 35. The urging unit 106 further includes a pushing member 104 for urging the urging member 105 about a shaft portion 105*a* provided at a lower portion of the urging member 105 in a counterclockwise direction and includes an urging spring 103. The pressing member 104 is disposed slidably in a predetermined stroke range in the front-rear direction of a fixing member 107 fixed to the apparatus main assembly 100A. The urging spring 103 is compressedly disposed between the pressing member 104 and the fixing member 107. The pushing member 104 is urged toward the front of the apparatus main assembly 100A, so that the urging member 105 is urged about the shaft portion 105*a* in the counterclockwise direction by being pushed by the pushing member 104.

FIG. 19(*a*) shows a state in which the holding members 34 are located in the first position and the tray 35 is located in the transfer contact position, by closing the door 31. In this state, the preventing claw 101 is lowered to a predetermined descent position (regulation position), so that its lower end portion is engaged in the recess 102*a*. The urging member 105 is pushed rearward by the portion to be urged 105 provided to the tray 35 to push and move the pushing member 104 rearward against the elasticity of the urging spring 103, thus being urged about the shaft portion 105*a* in the clockwise direction. On the portion to be urged 35*h*, a compressive reaction force of the urging spring 103 acts via the pressing member 104 and the urging member 105.

FIG. 19(*b*) shows a state in which the holding members 34 are located in the second position and the tray 35 is located in the push-in position, by opening the door 31 from the state of FIG. 19(*a*). In this state, the tray is moved upward by a predetermined distance but the preventing claw 101 still engages with the recess 102*a* at its lower end portion. That is, the tray 35 is regulated so that it is prevented from moving from the push-in position toward the pull-out position by the urging force of the urging member 105 through engagement of the preventing claw 101 with the recess 102*a*.

Figure 31:
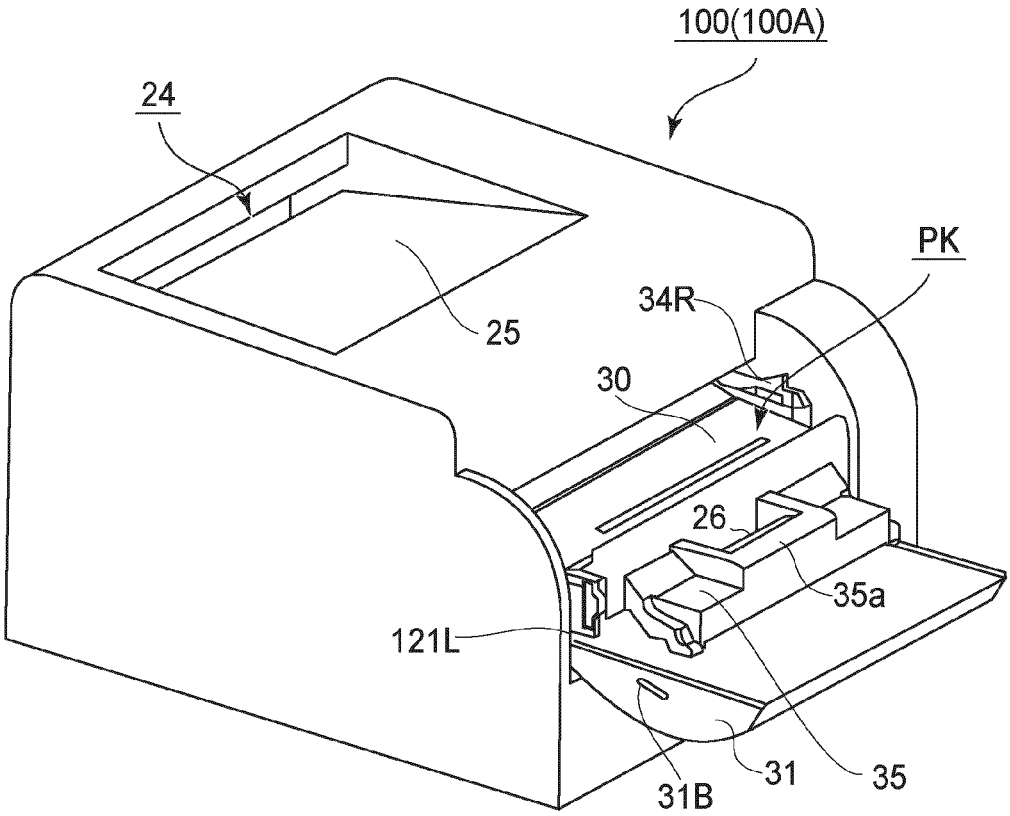
FIG. 31 is a schematic perspective view of the image forming apparatus placed in a state in which the tray is moved from a push-in position to a predetermined position by an urging force of an urging member.

Then, both the fixed portion 35*a*, which is provided on the front side of the tray 35 and exposed from the opening 30, and the lever 26, disposed inside the fixed portion 35*a*, are held. The lever 26 and the fixed portion 35*a* are provided downstream from a mounting portion of the tray 35 with respect to the pulling-out direction of the tray 35. Further, the fixed portion 35*a* is provided in a position closer to the pull-out position than that of the lever 26. Further, the lever 26 and the fixed portion 35*a* are exposed toward the upper portion of the tray 35 and projected upward and frontward with respect to a main body of the tray 35. The lever 26 is a movable portion movable with respect to the main body of the tray 35 and the fixed portion 35*a* is fixed to the main body of the tray 35. As shown in FIG. 19(*c*), by the above-described holding, the lever 26 is rotationally moved about the shaft portion 26*a* in the counterclockwise direction (lock-releasing direction). By this rotational movement of the lever 26, the arm portion 26*b* as the releasing portion is moved upward in a state of engagement with the vertically elongated hole 101*c*. By this arrangement, the preventing claw 101 is moved upward against the pushing down force of the spring 101*a*. As a result, the lower end portion of the preventing claw 101 comes out of the recess to release the regulation of movement of the tray 35. That is, the preventing claw 101 is retracted from the regulating position for regulating the tray 35 so as to be moved toward the pull-out position, i.e., is moved from the regulating position toward the pull-out position. Then, the tray 35 is moved from the push-in position to a predetermined position by the urging force of the urging member 105 (FIG. 19(*d*)). This predetermined position is a position in which only the cartridge PK located on a frontmost side of the plurality of the cartridges P is exposed (FIG. 31). Further, a direction in which the lever 26 is moved by manual operation substantially coincides with the direction of the tray from the push-in position toward the pull-out position. By this, the user can easily pull out of the tray 35. Then, as shown in FIG. 19(*e*), the pushed-out tray 35 is slid frontward relative to the holding members 34. By this arrangement, as shown in FIGS. 5 and 6, the tray 35 is sufficiently pulled out from the opening 30 to the pull-out position located outside of the apparatus main assembly 100A.

As shown in FIGS. 5 and 6, the tray 35 is pulled out to the pull-out position, where the cartridge to be replaced is replaced, and then the tray 35 is sufficiently pushed in the apparatus main assembly 100A to reach the push-in position, thus restoring the tray 35 to the state of trays 3 and 4.

In this case, as shown in FIG. 19(*f*), in the case where the tray 35 is located in a predetermined position before the push-in position, the portion to be urged 35*h* provided to the rear end of the tray 35 contacts the upper end portion of the urging member 105. Further, when the tray 35 is pushed in against the urging force of the urging member 105, an inclined cam portion 101*d* provided to the lower end portion of the preventing claw 101 contacts an inclined cam portion 102*b* provided to the fixed member 102. When the tray 35 is further pushed in against the urging force of the urging member 105, the preventing claw 101 is moved upward against the force of the spring 101*a* by the cam action of the inclined cam portions 101*d* and 102*b*. By this arrangement, as shown in FIG. 19(*g*), the preventing claw 101 runs up onto the upper surface of the fixed member 102. Thus, the preventing claw 101 is moved from the regulating position to the retracted position. Thereafter, the tray 35 is continuously pushed in against the urging force of the urging member 105. As a result, the preventing claw 101 moves to the position of the recess 102*a*, so that the lower end portion of the preventing claw 101 is engaged in the recess 102*a* by downward movement thereof by the spring 101*a*. That is, the preventing claw 101 is moved from the retracted position to the regulating position. By this, as shown in FIG. 19(*b*), the tray 35 is locked in the apparatus main assembly 100A. That is, by sufficiently pushing the tray 35 to the push-in position, the preventing claw 101 is engaged in the recess 102*a*. By this, the movement of the tray 35 is regulated in the push-in position.

Then, by closing the door 31, the holding members 34 are moved from the second position to the first position. By this movement, as shown in FIG. 19(*a*), the tray 35 is moved to the transfer contact position (latent image forming position) to place the image forming apparatus 100 in a state in which the apparatus can effect an image forming operation.

FIG. 17 is a perspective view showing a state in which the tray 35 is not pushed in to the push-in position in a state in which the holding members 34 are pushed up by the opening operation of the door 31. FIG. 18 is a perspective view showing a state in which the tray 35 is completely pushed in to the push-in position.

Figure 20:
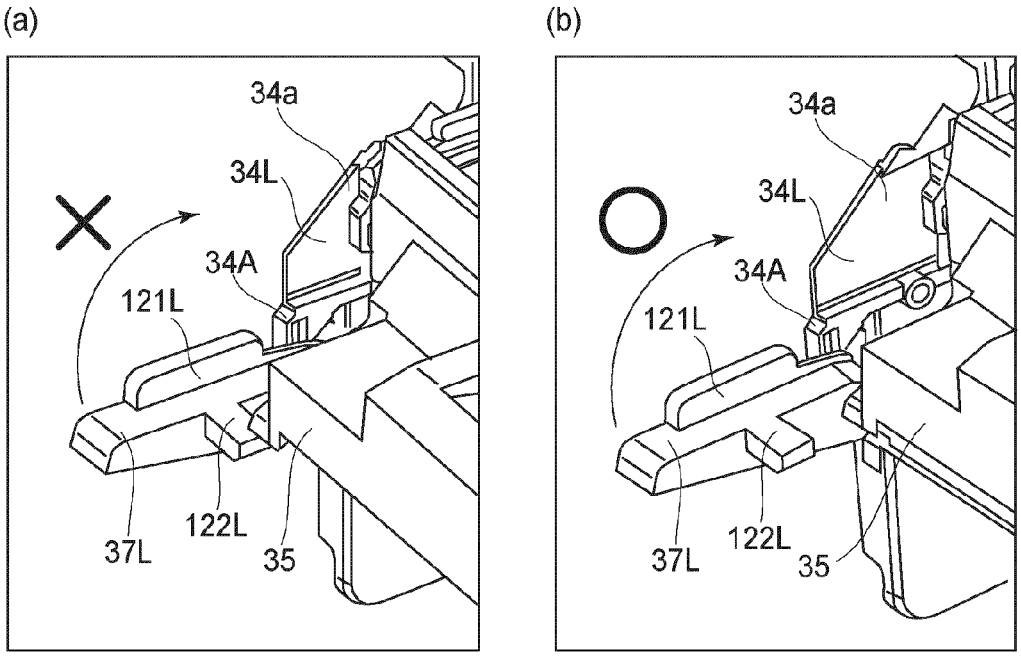

In the state of FIG. 17 in which the tray 35 is not completely pushed in, the preventing claw 101 and the recess 102*a* are not engaged with each other. In this case, the tray 35 is pushed back toward the pull-out position by a predetermined distance by the urging member 105 (FIG. 19(*f*) and FIG. 20(*a*)). That is, in the case where the tray 35 is located in a predetermined position, apart from the push-in position, between the pull-out position and the push-in position, the tray 35 is returned toward the pull-out position. The predetermined position is a position, close to the push-in position, in which the tray 35 can contact the urging member 105 and in which only the cartridge PK of the plurality of the cartridges P is exposed. Then, the tray 35 is urged by the urging member 105, so that the tray 35 is returned toward the pull-out position. The position of the returned tray 35 is also the position in which only the cartridge PK of the plurality of the cartridges P is exposed (FIG. 31). In this state, the door 31 cannot be closed, so that the holding members 34 cannot be moved from the second position to the first position. That is, as shown in FIG. 20(*a*), in interrelation with the closing operation of the door 31, when the connecting arms 37 (37L, 37R) as interference members are rotationally moved, interference portions 122 (122L, 122R) provided to the connecting arms 37 (37L, 37R) interfere with the lower surface of the tray 35 placed in the returned state. For that reason, the holding members 34 cannot be pushed down toward a rear lower side of the apparatus main assembly 100A (i.e., cannot be moved from the second position to the first position) by closing the door 31. In other words, in the state in which the tray 35 is located in a position other than the push-in position, the closing of the opening 30 is prohibited.

On the other hand, in the state of FIG. 18 in which the tray 35 is pushed in to the push-in position, when the connecting arms 37 are rotationally moved in interrelation with the closing operation of the door 31, the interference portions 122 do not interfere with the tray 35 (FIG. 20(*b*)). For that reason, the holding members 34 and the tray 35 can be pushed down (i.e., can be moved from the second position to the first position) by closing the door 31.

As described above, the tray 35 is urged by the urging unit 106 (urging member 105) from the rear. For that reason, in the case where the user does not sufficiently push the tray 35 in to the push-in position, the tray 356 is projected from the apparatus main assembly 100A by a predetermined distance, depending on the amount of the stroke of the spring 103 of the urging unit 106 (FIG. 19(*f*)). At this time, the tray 35 is placed in the state shown in FIG. 17 and FIG. 20(*b*). Accordingly, in the case where the user erroneously closes the door 31 without pushing the tray 35 in to the push-in position, the interference portions 122 projected from the connecting arms 37 interfere with the tray with reliability, so that it is possible to prompt the user to correct the erroneous operation.

On the other hand, in the state of FIGS. 18 and 20(*b*) in which the tray 35 is pushed in to the push-in position, the preventing claw 101 is engaged in the recess 102*b*. For that reason, as shown in FIG. 19(*b*), the tray 35 is positioned with respect to the apparatus main assembly 100A. Accordingly, in this state, when the door 31 is closed, it is possible to not only engage the U-shaped groove 110 of the tray 35 (FIGS. 11(*a*)-11(*c*)) with pin 111 but also to engage the projections 67 with the positioning holes 69 with reliability.

As described above, in the case where the tray 35 is located in the push-in position, the holding members 34 can be moved from the second position to the first position (i.e., the tray 35 can be moved from the push-in position to the transfer contact position). Further, in the case where the tray 35 is not pushed in to the push-in position, the tray 35 is pushed back toward the pull-out position by the predetermined distance by the urging member 105. As a result, the tray 35 interferes with the door 31, so that the door 31 cannot be closed. Further, the holding members (holding means) 34 cannot be moved from the second position to the first position.

The number and shape of the preventing claw 101 and the recess 102*a* are not limited to those as shown in FIGS. 19(*a*) to 19(*g*). Further, it is also possible to appropriately change the number, the shape, and the structure of the urging unit 106 as shown in FIGS. 19(*a*) to 19(*g*). Further, the releasing mechanism provided to the tray 35 may also be provided to the apparatus main assembly 100A.

In this embodiment, the cartridges P can be easily replaced in the front-access manner. Each cartridge P can be replaced in a state in which it is mounted in the tray 35. Further, by the members on the apparatus main assembly 100A side, the cartridges P can be positioned during mounting thereof into the apparatus main assembly 100A. The tray 35 is configured to roughly hold the cartridges P and move between the pull-out position and the push-in position. By this arrangement, the user can set each cartridge P into the tray 35 from right above a corresponding mounting position of the tray 35 without paying attention to the positioning in the pull-out position of the tray 35. Thereafter, the user pushes the tray 35 in to the push-in position and closes the door 31, whereby it is possible to effect the positioning of the cartridges P with reliability. By this arrangement, it is possible to provide an image forming apparatus which allows a simple mounting operation by the user and is capable of ensuring positional accuracy for each cartridge P.

When the tray 35 is operated in such a state that the tray 35 is not completely raised to the second position, e.g., in a half-open state of the door 31, there is a possibility of an occurrence of an image problem caused by rubbing of the drum 1 of each cartridge P with the belt 13. However, in this embodiment, it is possible to realize a state in which the tray 35 cannot be operated until the user completely opens the door 31, by providing the members for regulating the movement of the door 31 in interrelation with the tray 35 and by providing the members for regulating the movement of the tray 35 by the opening/closing operations of the door 31.

Further, by employing such a constitution that the tray 35 is projected from the apparatus main assembly 100A by the predetermined distance unless the user completely accommodates the tray 35 into the apparatus main assembly 100A, it is possible to notify the user that the door 31 cannot be closed until the user completely accommodates the tray 35 into the apparatus main assembly 100A. Thus, it is possible to prevent breakage of parts of the image forming apparatus resulting from an operating error by the user.

Incidentally, the above described combination of the projections 67 and holes 69 (FIGS. 21(*a*) to 21(*c*)) can be utilized as the substitute for the preventing claw 101 shown in FIGS. 19(*a*) to 19(*g*). This will be described with reference to FIGS. 17, 18 and 21.

When the tray 35 is in the state shown in FIG. 17, in which the tray has not been completely pushed back into the apparatus main assembly, the projection 67 of the tray 35 is not in alignment with the hole 69 provided to the belt holding member 68 (FIG. 21(*a*)). When an attempt is made to close the door 31 in this state, the holding members 34 are lowered together with the tray 35 through the connecting arms 37. At this time, the projection 67 strikes the belt holding member 68. For this reason, the door 31 cannot be closed.

On the other hand, in the state shown in FIG. 18 in which the tray 35 has been completely pushed back into the apparatus main assembly, the projection 67 enters the hole 69 as shown in FIGS. 21(*b*) and 21(*c*). Therefore, the door 31 can be closed to lower the holding members 34 and the tray 35. As a result, the door 31 can be completely closed.

Therefore, the tray 35 can be lowered only when the tray 35 is located in the push-in position, so that each cartridge P is precisely positioned by the positioning member 41.

Referring to FIGS. 17, 18 and 21(*a*) to 21(*c*), in this embodiment, the tray 35 is provided with two projections 67 which are the same in shape, and the belt holding member 68 is provided with two holes 69 that are the same in shape. However, the number and shape of the projections 67 and the holes 69 do not need to be as shown in FIGS. 17, 18, and 21(*a*) to 21(*c*). Further, when two or more projections and holes are provided, they do not need to be the same in shape. Further, the manner in which each projection 67 fits into the corresponding hole 69 does not need to be exactly as shown in FIGS. 17, 18, and 21(*a*) to 21(*c*). Moreover, the hole 69 does not need to be provided to a part of the belt supporting member 68.

As shown in FIGS. 11(*a*) to 11(*c*), by the combination of the pin 111 provided to the right frame 80R and the U-shaped groove 110 provided to the tray 35, a similar effect can be achieved. Also in this case, the number and the shape of the engaging points do not need to be as shown in FIGS. 11(*a*) to 11(*c*).

(Electric Energy Supplying Constitution)

A method of supplying electrical energy from the apparatus main assembly 100A to each cartridge P will be described with reference to FIGS. 22, 23 and 24(*a*) and 24(*b*).

Figure 22:
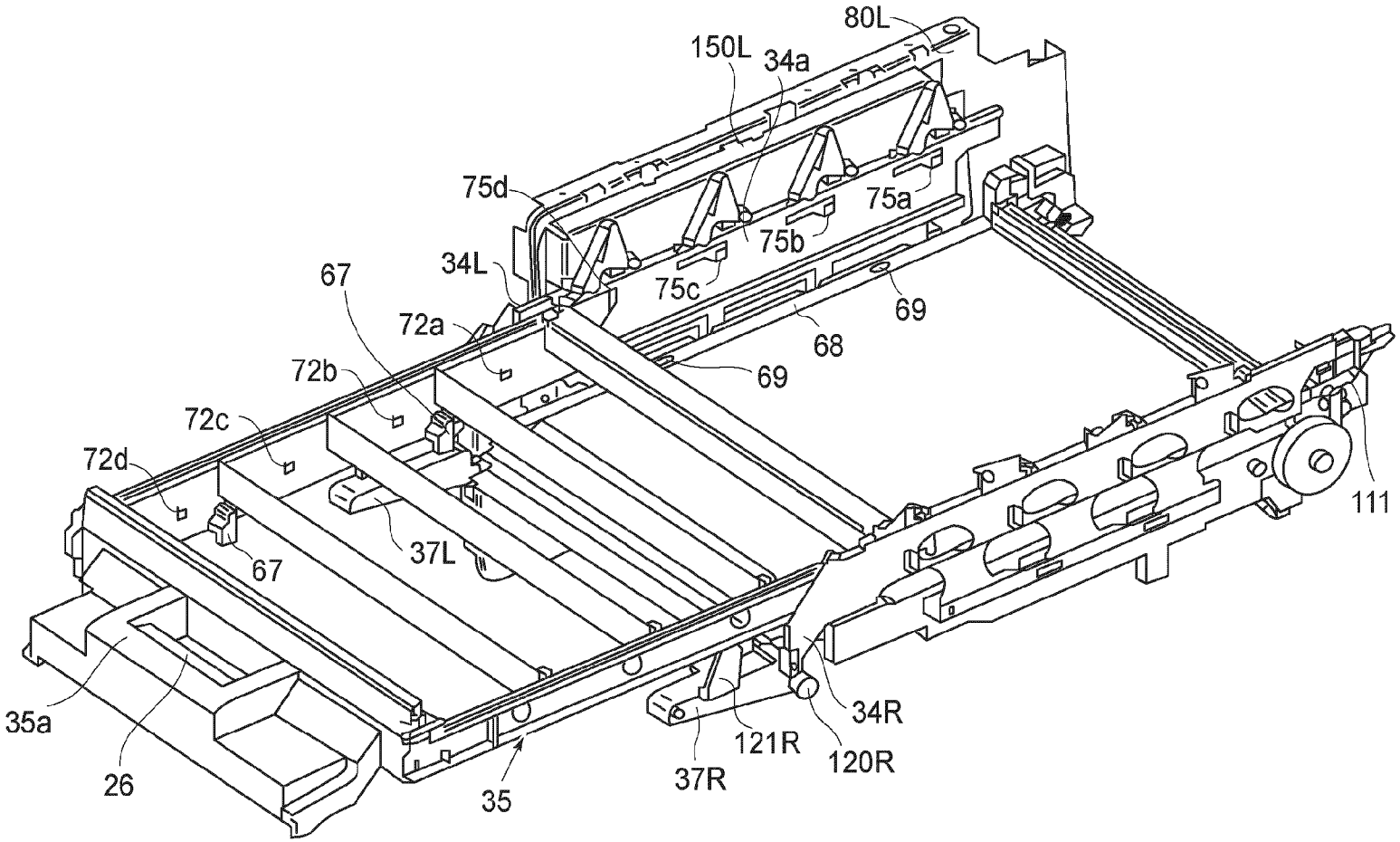
FIGS. 22, 23, and 24(*a*) and 24(*b*) are schematic views each for illustrating a means for supplying electrical to the cartridge.

Each of FIGS. 21 and 22 shows a state in which the tray 35 has been completely pulled out by opening the door 31. The tray 35 is provided with a plurality of sets of intermediary electrical contact springs 72*a* to 72*d*, which are aligned in the direction parallel to the horizontal direction of the apparatus main assembly 100A and are located at the same positional level with respect to the vertical direction. One end of each intermediary electrical contact spring 72 is electrically connected to a corresponding electrical contact 55 (FIG. 8) of the cartridge. That is, the tray 35 is provided with the intermediary electrical contacts 72*a* and 72*d*, which are electrically connected to the corresponding cartridges 55 of the cartridges P, respectively.

The main frame of the apparatus main assembly 100A is provided with a plurality of main assembly electrical contact springs 75*a* to 75*d* electrically connected to a main assembly-side electric energy supplying portion 74 provided to an outside of the left frame 80L. These main assembly electrical contact springs 75*a* to 75*d* are aligned in the horizontal direction at the same positional level with respect to the vertical direction. The main assembly electrical contact springs 75*a* to 75*d* project toward the tray 35 through holes provided to the left frame 80L and the holes provided to the left holding member 34L.

Figure 24:
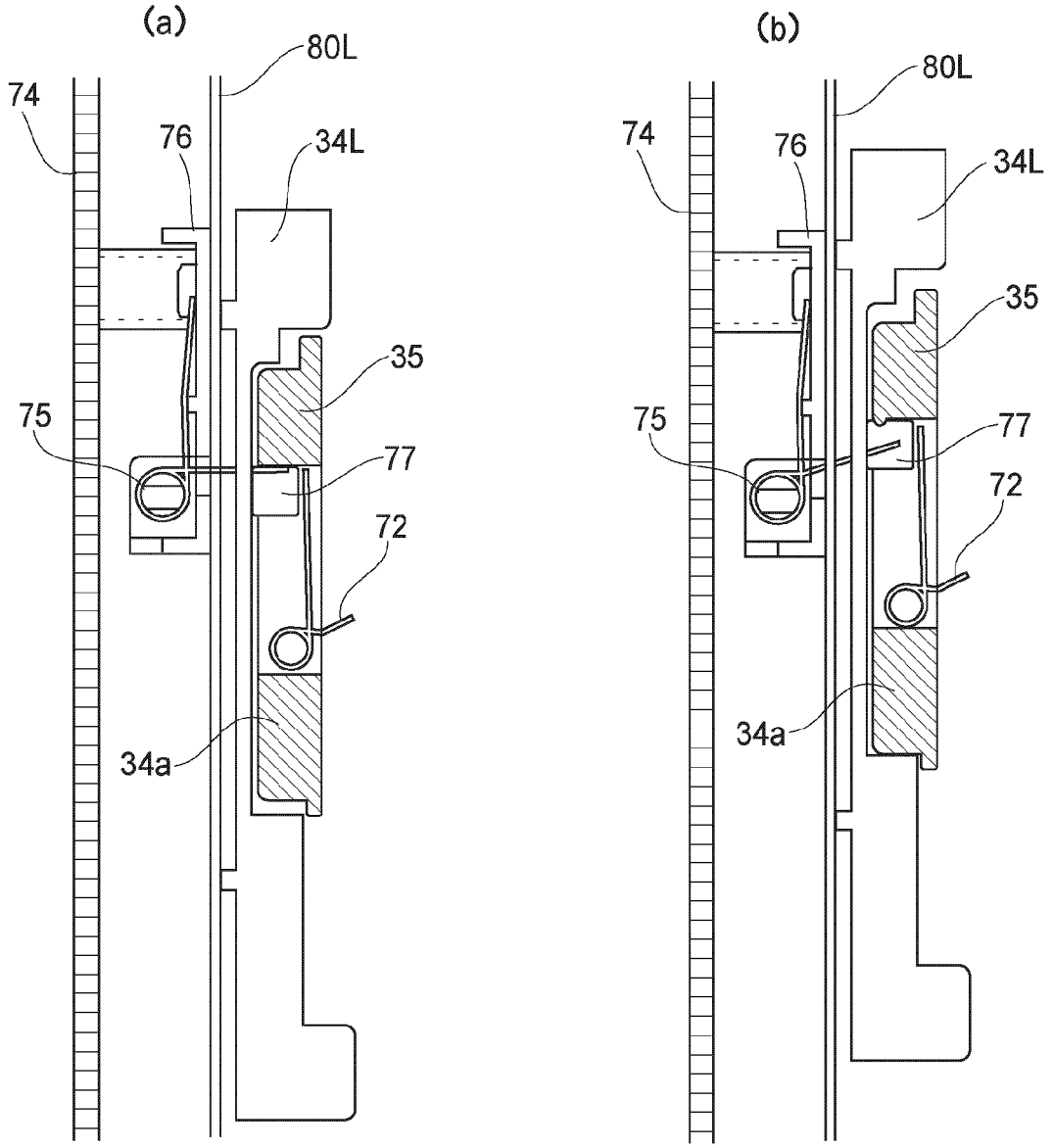

FIGS. 24(*a*) and 24(*b*) show how the intermediary electrical contact spring 72 provided to the tray 35 is electrically connected to or disconnected from the main assembly electrical contact spring 75 on the apparatus main assembly side. FIGS. 24(*a*) and 24(*b*) show the same portions of a sectional view of the tray 35, the intermediary electrical contact spring 72, the left tray holding member 34L, the left frame 80L, the main assembly electrical contact spring 75, the main assembly electrical contact spring holder 76, and the electrical energy supplying portion 74 on the apparatus main assembly side, as seen from the front side of the apparatus main assembly 100A.

FIG. 24(*a*) shows the state in which the door 31 is in the closed position, and the left tray holding member 34L and the tray 35 are in their transfer contact positions, into which they have been lowered. In this state, the main assembly electrical contact spring 75 is electrically in contact with the intermediary electrical contact spring 72.

FIG. 24(*b*) shows the state in which the door 31 is in the open position, and the left tray holding member 34L and the tray 35 are in their positions to which they have been raised from the transfer contact positions. In this state, the main assembly electrical contact spring 75 and the intermediary electrical contact spring 72 are placed in an electrically disconnected state. In order to prevent the tray 35 from contacting a portion of the main assembly electrical contact spring 75 which projects toward the tray 35 through the left holding member 34L, the tray 35 is provided with a groove 77 which extends in the front-rear direction of the apparatus main assembly 100A. By this, the tray 35 can be pulled out without coming in contact with the main assembly electrical contact spring 75.

That is, the apparatus main assembly 100A is provided with the main assembly electrical contacts 75*a*-75*d*, which are disposed so that their positions do not coincide with the movement path of the intermediary electrical contacts 72*a*-72*d*. The apparatus main assembly is structured so that the electrical connection between the intermediary electrical contacts and their corresponding main assembly electrical contacts can be broken by moving upward (raising) the tray 35 from the transfer contact position by the holding members 34 and can be established by moving downward (lowering) the tray 35 toward its transfer contact position by the holding members 34.

In FIGS. 22, 23, and 24(*a*) and 24(*b*), a method of supplying electrical energy (power) to one portion to be supplied with electric energy for each cartridge P by using a combination of one main assembly electrical contact spring and one intermediary electrical contact spring is shown. However, the image forming apparatus of the present invention can be similarly configured also in the case where each cartridge P is provided with a plurality of portions to be supplied with electrical energy. Further, it is also possible to similarly configure the image forming apparatus by disposing a plurality of main assembly electrical contact springs different in vertical positional level and providing a plurality of grooves depending on the heights of the main assembly electrical contact springs provided to the tray 35 even in the case where a plurality of portions to be supplied with electrical energy is different in height in the vertical direction.

In the case where the same bias is applied to the plurality of cartridges P, an electroconductor as one intermediary electrical contact which is electrically connectable and disconnectable with one main assembly electrical contact spring is provided in the tray 35. Further, in the tray 35, a plurality of intermediary electrical contact springs are supplied, which are electrically connected to the electroconductor at their ends on one side and which are electrically connectable and disconnectable with a plurality of portions to be supplied with electrical energy of the plurality of cartridges at their ends on the other side. By this constitution, it is possible to reduce the number of connecting points between the intermediary electrical contact springs and the main assembly electrical contact springs.

The tray 35 is configured to employ such a constitution that electroconductors for distributing the electrical connection are provided in the tray 35 so as to increase the number of electrically connecting points between intermediary electrical contacts and cartridge electrical contacts compared with that of electrically connecting points between the intermediary electrical contacts and main assembly electrical contacts. By this, in the case where the same potential is used for each of the different colors, the number of parts can be reduced, thus resulting in a cost reduction.

As described above, the intermediary electrical contacts are provided to the tray 35 for mounting the cartridges P, so that the electrical connection and the electrical disconnection with the apparatus main assembly 100A can be controlled by vertical movement of the tray 35. By this, it is possible to provide an image forming apparatus having a cartridge replacing constitution of an easy pulling-out type without increasing the cost and the size of the apparatus main assembly.

Further, it is possible for the user to replace the cartridges in an easy-to-perform operation by vertical movement of the tray 35 in interrelation with the door 31 which opens and closes the opening 30.

Further, by arranging a plurality of electrical contacts in the horizontal direction at the same vertical positional level, it is possible to save space in the vertical direction to realize a compact apparatus main assembly size.

(Stay Member)

Figure 26:
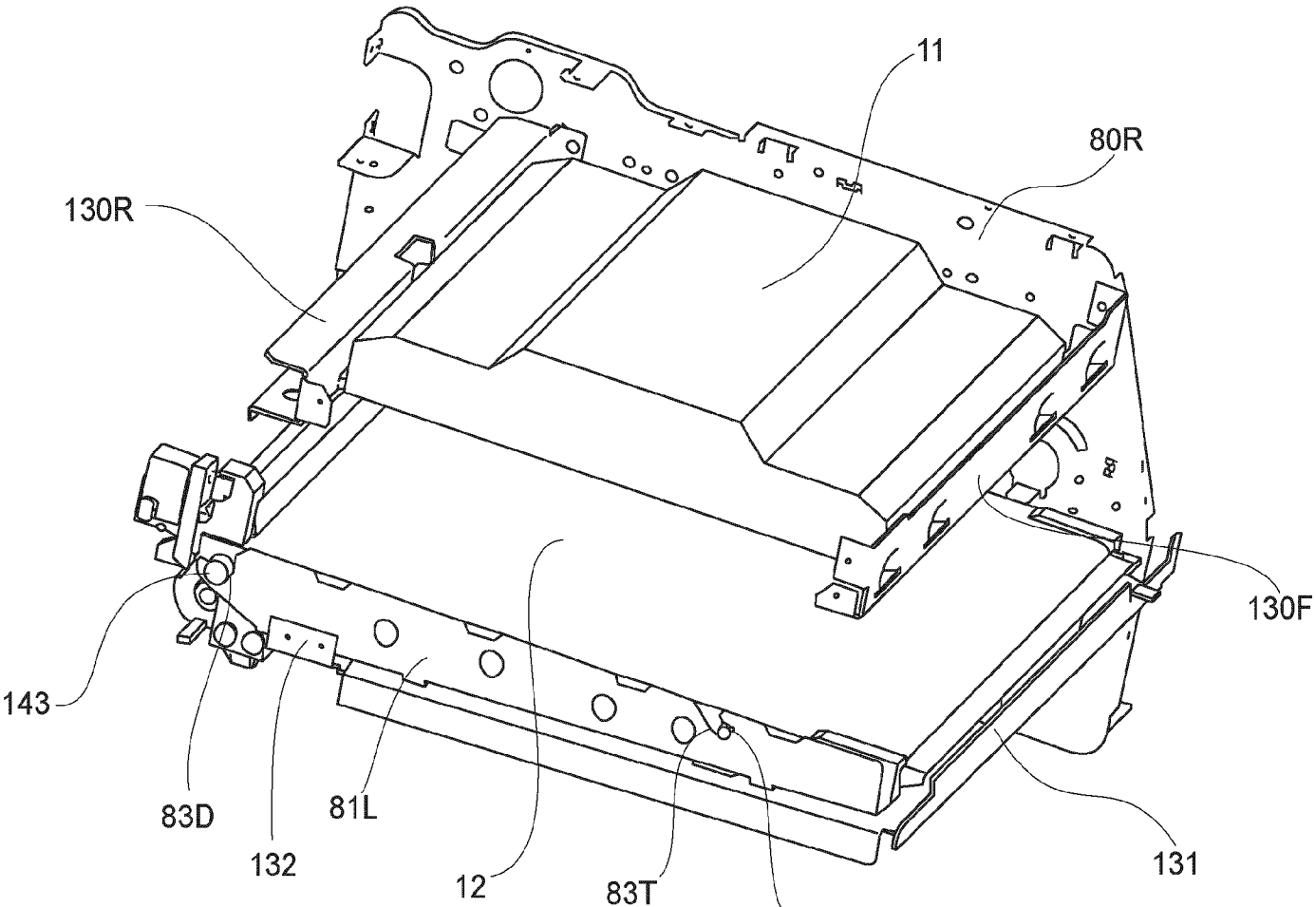
Figure 27:
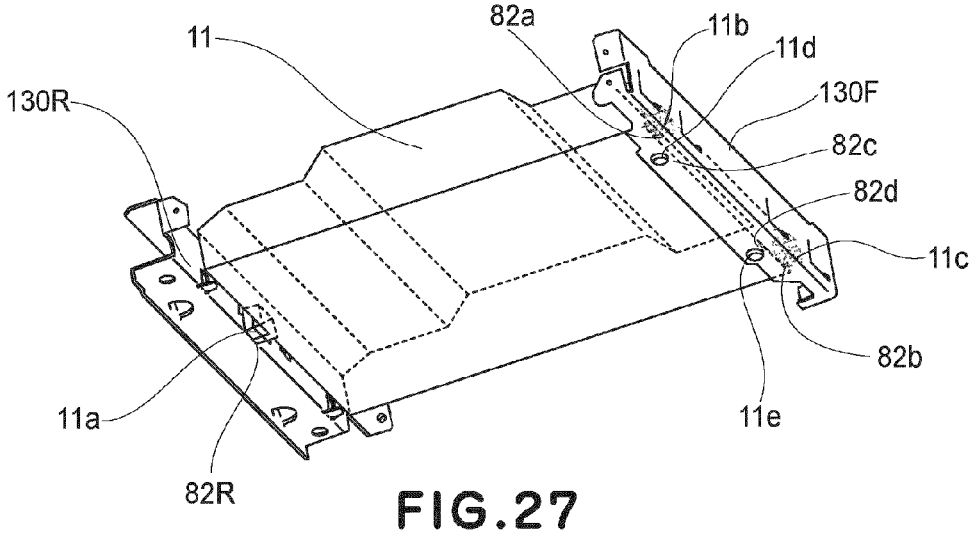

FIGS. 25-27 are perspective views each showing a main assembly frame constituting a main frame of the main assembly of the image forming apparatus. The left frame 80L (not shown in these figures) and the right frame 80R as the first and second main frames of the apparatus main assembly are connected and constituted by stay members 130F, 130R, 131 and 132.

On the stay members 131 and 132, the cartridges P (PY, PM, PC, PK) and stay members (81L, 81R) for holding a belt unit 12 are disposed. The stay members 81 position the cartridges P and the belt unit 12. Each of the stay members 81 is provided with four positioning portions 41 (41Y, 41M, 41C, 41K) with which the bearing portions 51 and 52 of the cartridges P are engaged to effect positioning of the cartridges P. Each of the positioning portions 41 has a recess having a generally V-shape cross-section and opening upwardly, and as described above, each cartridge P is downwardly pressed by the corresponding pressing member 42, so that the cartridges P are positioned. On the other hand, by slightly raising the cartridges P, the cartridges P can be horizontally pulled out without interfering with the stay members 81L and 81R.

The belt unit 12 is disposed between the two stay members 81L and 81R and positioned by engaging positioning bosses 143 and 144 with positioning portions 83D and 83T of the stay members 81L and 81R.

The stay members (81L, 81R) are designed to have the same shape and are processable with a common mold. The stay members 81L and 81R have a small relative difference in dimension, so that they have an advantageous constitution for positioning the cartridges P and the belt unit 12. The stay members 81L and 81R are subjected the bending in L-shape and are connected to the stay members 131 and 132 with screws.

The stay members 131 and 132 position the scanner unit 11. Legs 11*a*, 11*b* and 11*c* of the scanner unit 11 are grounded on the stay members 130F and 130R to determine a position of the scanner unit 11 with respect to the height direction. Further, positioning bosses 11*d* and 11*e* of the scanner unit 11 are engaged with positioning holes 82*c* and 82*d* of the stay member 130F. By this, a horizontal position of the scanner unit 11 is determined. As described above, during the replacement of the cartridges P, the cartridges P can be pulled out by slightly raising the cartridges P. Therefore, there is no need to provide a large space for replacing the cartridges below the scanner unit 11.

Figure 30:
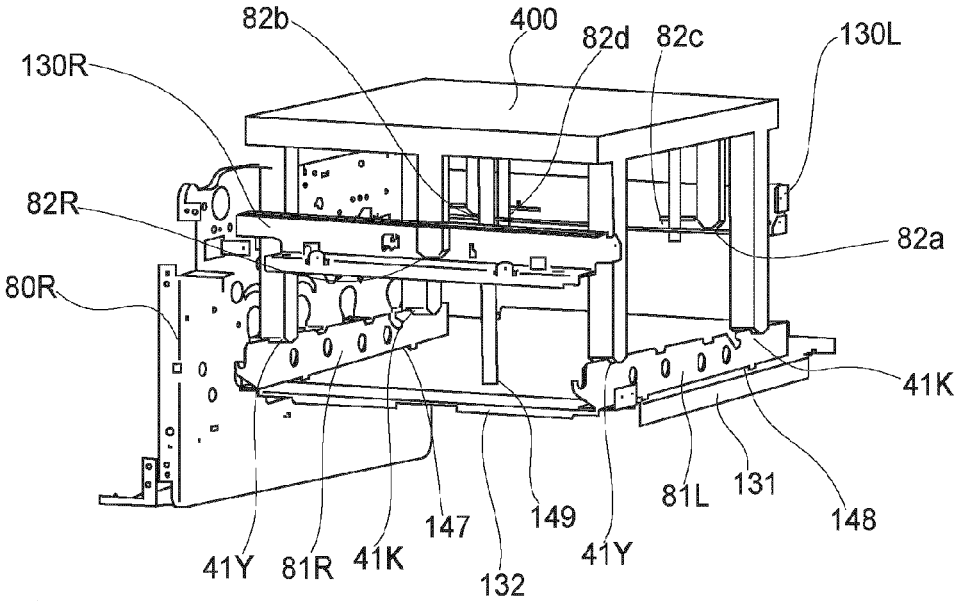
FIG. 30 is a schematic view for illustrating members for assembling a frame of a main assembly of the image forming apparatus.

FIG. 30 is a schematic view for illustrating assembling of the main assembly frame constituting the main frame of the image forming apparatus main assembly. The stay members are capable of ensuring positional accuracy of the main assembly frame by being connected with screws in a state in which cartridge positioning portions 41Y and 41K and the scanner unit positioning portions 82 strike a builtup tool 400.

The stay members 81L and 81R are held by the stay members 131 and 132. The stay member 131 has abutting portions 147, 148 and 149 which have been subjected to upward half blanking processing, and other portions of the stay member 131 are spaced from the stay members 81L and 81R. The stay member 131 is connected with screws in a state in which the three abutting portions 147, 148 and 149 are pressed against the stay members 81L and 81R. Further, the stay member 132 is connected with screws in a state in which the stay member 132 is pressed against the stay member 81L and 81R.

The accuracy of metal plate parts, such as cold-rolled steel plates generally used for constituting the main assembly frame, are lowered by a bow or a kink of a flat surface caused by their sizes. Further, it is difficult for metal plate parts with high rigidity to correct their accuracy. The stay members 81L and 81R can also be connected only to the stay member 131 but by the influence of the part accuracy of the stay member 131, desired positional accuracy of the stay members 81 cannot be obtained in some cases.

In this embodiment, the stay members 81L and 81R are supported by the two stay members 131 and 132 and contact areas therebetween are reduced, so that the influence of the part accuracy of the stay members 131 and 132 can be eliminated. Therefore, it is possible to assemble the main assembly frame with high precision.

The stay members 131 and 132 have a both end support beam structure in which both ends of each of the stay members 131 and 132 are connected to the left frame 80L and the right frame 80R, thus ensuring their strengths with respect to a static load such as the self-weight or pressing force of the process cartridges and impact load during physical distribution or the like.

Figure 28:
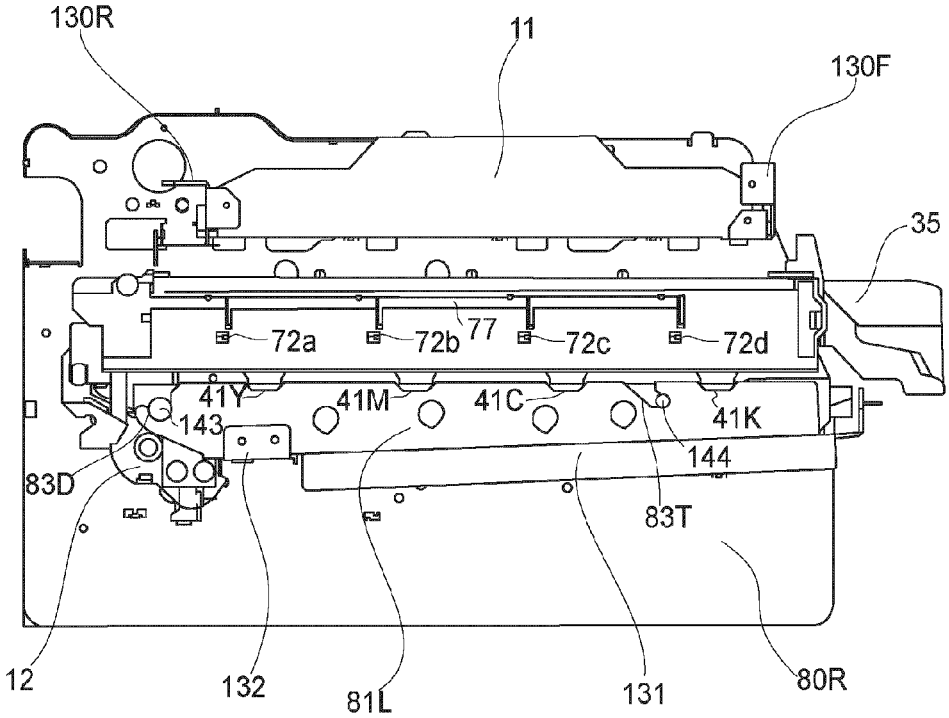
Figure 29:
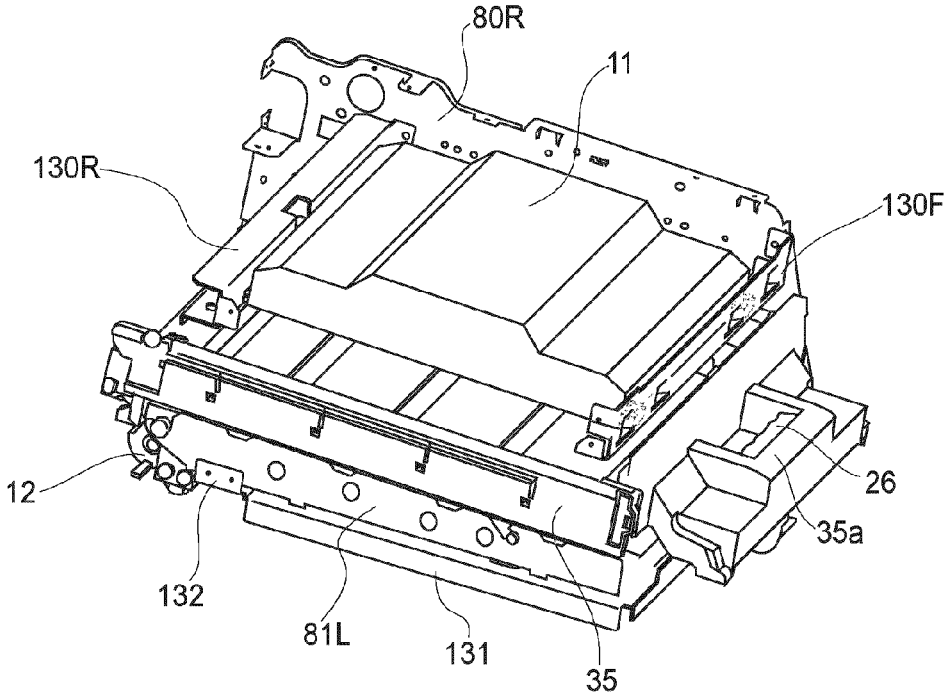

As shown in FIGS. 28 and 29, the stay members 131 and 132 are disposed below the tray 35. In the case where the stay members 81 are directly connected to the side plates, they prevent the tray 35 and the holding members 34 disposed inside the side plates from moving toward the outside of the apparatus main assembly 100A. Therefore, there is apprehension that the size of the apparatus main assembly 100A is increased. However, in this embodiment, the space between the side plates can be effectively utilized. More specifically, the stay member 130F is disposed above the tray 35, so that a large opening can be provided at a front portion of the apparatus main assembly 100A. Therefore, the tray 35 can be moved with no increase in size of the apparatus main assembly 100A.

As described hereinabove, the image forming apparatus according to the present invention can perform easy replacement of the process cartridge(s) through the moving operation of the tray.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 136453/2007 filed May 23, 2007, and 059560/2008 filed Mar. 10, 2008, which are hereby incorporated by reference.

What is claimed is:

1. An electrophotographic image forming apparatus comprising:

a tray movable between a pull-out position in which said tray is outside of a main assembly of said apparatus and a push-in position in which said tray is inside of the main assembly of said apparatus, said tray including a mounting portion configured and positioned to detachably mount a cartridge in the pull-out position;

an urging member configured and positioned to urge said tray from the push-in position toward the pull-out position; and wherein, when said tray is moved from the pull-out position to the push-in position, said urging member contacts said tray to apply an urging force for urging said tray in a direction toward the pull-out position.

2. An apparatus according to claim 1, wherein said tray includes a portion to be urged by said urging member, said portion to be urged being provided upstream of said tray with respect to the pull-out position of said tray.

3. An apparatus according to claim 1, wherein the main assembly of the apparatus includes (i) an opening through which said tray passes when said tray moves from the push-in position to the pull-out position, and (ii) a door capable of closing the opening in a state in which said tray is located in the push-in position.

4. An apparatus according to claim 1, wherein said cartridge includes a developer carrying member configured and positioned to carry the developer in order to develop a latent image formed on an electrophotographic photosensitive member.

5. An apparatus according to claim 4, wherein said cartridge includes said electrophotographic photosensitive member.

6. An apparatus according to claim 5, wherein the main assembly of said apparatus includes a transfer member configured and positioned to transfer a developer image formed on said electrophotographic photosensitive member, wherein said tray is located in a transfer contact position in which said electrophotographic photosensitive member and said transfer member contact each other and a transfer separation position, as the push-in position, in which said electrophotographic photosensitive member and said transfer member are separated from each other, and wherein said tray is moved from the transfer contact position to the transfer separation position by opening of a door.

7. An apparatus according to claim 1, wherein a moving direction of said tray in which said tray moves between the push-in position and the pull-out position is perpendicular to a longitudinal direction of said cartridge.

8. An apparatus according to claim 1, wherein a plurality of cartridges are mountable to said mounting portion.

9. An apparatus according to claim 8, wherein said pull-out position is a position where the plurality of cartridges are detachably mountable to said tray, and wherein during movement of said tray from the pull-out position to the push-in position, said urging member contacts said tray to apply an urging force for urging said tray in the direction toward the pull-out position.

10. An apparatus according to claim 1, further comprising a regulating member configured and positioned to regulate movement of said tray toward the pull-out position by engagement thereof with the main assembly of said apparatus when said tray is located in the push-in position.

11. An apparatus according to claim 10, wherein said regulating member is provided to said tray, wherein a portion to be engaged is provided to the main assembly of the apparatus, and wherein said regulating member is engaged with said portion to be engaged in the regulating position in the state in which said tray is located in the push-in position to regulate movement of said tray.

12. An apparatus according to claim 11, further comprising an inclined portion for facilitating engagement between said regulating member and said portion to be engaged during movement of said tray from the pull-out position to the push-in position, wherein said inclined portion is provided on at least one of said regulating member and said portion to be engaged.

13. An apparatus according to claim 10, further comprising a releasing portion for releasing regulation by said regulating member in a state in which said tray is located in the push-in position.

14. An apparatus according to claim 10, wherein said regulating member is provided downstream of said tray with respect to the pull-out position of said tray.

* * * * *